US008806877B2

(12) United States Patent
Tamaki et al.

(10) Patent No.: US 8,806,877 B2
(45) Date of Patent: Aug. 19, 2014

(54) REFRIGERATING CYCLE APPARATUS

(75) Inventors: Shogo Tamaki, Tokyo (JP); Kosuke Tanaka, Tokyo (JP); Fumitake Unezaki, Tokyo (JP); Takuya Ito, Tokyo (JP); Kazuhiro Komatsu, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 547 days.

(21) Appl. No.: 13/203,274

(22) PCT Filed: Mar. 26, 2010

(86) PCT No.: PCT/JP2010/055388

§ 371 (c)(1),
(2), (4) Date: Aug. 25, 2011

(87) PCT Pub. No.: WO2010/113804

PCT Pub. Date: Oct. 7, 2010

(65) Prior Publication Data

US 2011/0308267 A1 Dec. 22, 2011

(30) Foreign Application Priority Data

Mar. 30, 2009 (JP) ..... 2009-082783

(51) Int. Cl.
*F25B 45/00* (2006.01)

(52) U.S. Cl.
USPC ..... 62/149; 62/222

(58) Field of Classification Search
CPC ..... F25B 45/00; F25B 2345/00; F25B 2345/001–2345/003; F25B 2600/05; F25B 2700/04
USPC ..... 62/126, 127, 129, 149, 174, 222, 228.3
See application file for complete search history.

(56) References Cited

U.S. PATENT DOCUMENTS

2009/0095000 A1 4/2009 Yoshimi et al.
2009/0126379 A1 5/2009 Yamaguchi et al.

(Continued)

FOREIGN PATENT DOCUMENTS

CN 1517626 A 8/2004
CN 1576750 A 2/2005

(Continued)

OTHER PUBLICATIONS

Office Action (Text Portion of the First Office Action) issued by the Chinese Patent Office on Apr. 27, 2013, in the corresponding Chinese Patent Application No. 201080015194.2, and an English Translation thereof. (22 pages).

(Continued)

*Primary Examiner* — Marc Norman
(74) *Attorney, Agent, or Firm* — Buchanan Ingersoll & Rooney PC

(57) ABSTRACT

A refrigerating cycle apparatus is obtained that can determine excess/shortage of a refrigerant amount in a refrigerating circuit at high precision even if a factor such as a heat exchanger whose refrigerant amount is difficult to calculate exists. The refrigerating cycle apparatus according to the present invention includes one heat source unit or more, one utilization unit or more, a refrigerating circuit constituted by the heat source unit and utilization unit, a storage part which stores an appropriate refrigerant amount of a refrigerant to be charged in the refrigerating circuit and a correction coefficient which corrects a liquid refrigerant amount such that calculation of the refrigerant amount of each constituent element of the refrigerating circuit is equal to the appropriate refrigerant amount, a measurement part which detects an operation state amount in each constituent element of the refrigerating circuit, a calculation part which calculates the refrigerant amount of each constituent element of the refrigerating circuit based on the operation state amount by using the correction coefficient, a comparison part which compares the appropriate refrigerant amount with a calculative refrigerant amount calculated by the calculation part, and a determination part which determines excess/shortage of the refrigerant amount charged in the refrigerating circuit based on a comparison result of the comparison part.

18 Claims, 12 Drawing Sheets

(56) References Cited

U.S. PATENT DOCUMENTS

| | | | | |
|---|---|---|---|---|
| 2010/0154447 | A1 | 6/2010 | Yoshimi et al. | |
| 2012/0318011 | A1 * | 12/2012 | Ochiai et al. | 62/127 |

FOREIGN PATENT DOCUMENTS

| | | | |
|---|---|---|---|
| EP | 1970651 | A1 | 9/2008 |
| JP | 4-148170 | A | 5/1992 |
| JP | 2001-027461 | A | 1/2001 |
| JP | 2006-292214 | A | 10/2006 |
| JP | 2007-163099 | A | 6/2007 |
| JP | 2007-187442 | A | 7/2007 |
| JP | 2007-198680 | A | 8/2007 |
| JP | 2007-255737 | A | 10/2007 |
| JP | 2007-292428 | A | 11/2007 |
| JP | 2008-064453 | A | 3/2008 |
| JP | 2008-111585 | A | 5/2008 |
| JP | 4124228 | B2 | 7/2008 |
| JP | 2009-079842 | A | 4/2009 |
| WO | WO 2007/069578 | A1 | 6/2007 |
| WO | WO 2008/035418 | A1 | 3/2008 |

OTHER PUBLICATIONS

International Search Report (PCT/ISA/210) issued on Jul. 6, 2010, by Japanese Patent Office as the International Searching Authority for International Application No. PCT/JP2010/055388.

* cited by examiner

REFRIGERATING CYCLE APPARATUS

TECHNICAL FIELD

The present invention relates to a refrigerating cycle apparatus such as an air conditioning apparatus and, more particularly, to a function of determining the excess/shortage of the refrigerant amount by calculating the refrigerant amount in a refrigerating circuit, comparing the calculative refrigerant amount and an appropriate refrigerant amount, and performing correction so that the two values become equal. Specifically, the present invention relates to a function of determining the excess/shortage of the refrigerant amount in a refrigerating circuit in a refrigerating cycle apparatus constituted by connecting a compressor, a condenser, a pressure reducing device, and an evaporator.

BACKGROUND ART

An example of a conventional air conditioning apparatus includes a separate type air conditioning apparatus in which a heat source unit and a utilization unit are connected via a connection pipe to constitute a refrigerating circuit. Examples of the separate type air conditioning apparatus include a room air conditioner and a package air conditioner.

An example of a refrigerating cycle apparatus in which a heat source unit and a utilization unit are integrated is an air-cooling heat pump chiller. In this refrigerating cycle apparatus, if a connecting portion such as a pipe is not fastened sufficiently, the refrigerant may leak gradually through a gap in the fastening portion of the pipe or the like over a long-term use of the refrigerating cycle apparatus.

Damage to the pipe may lead to an unexpected refrigerant leakage. The refrigerant leakage causes a decrease in air conditioning capacity and damage to the constituent devices. In a serious case, the refrigerating cycle apparatus may have to be stopped for safety reasons.

If the refrigerating circuit is charged with the refrigerant excessively, the liquid refrigerant runs under a pressure in the compressor for long period of time, leading to a failure. Therefore, from the viewpoint of the quality and improving the maintenance easiness, it is desirable that a function is provided that determines the excess/shortage of the refrigerant amount by calculating the amount of refrigerant charged in the refrigerating cycle apparatus.

To cope with these problems, conventionally, a method has been proposed, of determining the excess/shortage of the refrigerant amount by calculating the refrigerant amounts in the respective elements which constitute the refrigerating circuit, by using an estimation formula obtained by regression analysis on operation state amounts which are highly correlated to each other in the respective elements (see, e.g., patent literatures 1 to 3).

CITATION LIST

Patent Literature

Patent literature 1: JP 2007-198680
Patent literature 2: JP 2007-292428
Patent literature 3: JP 4124228

SUMMARY OF THE INVENTION

Technical Problem

With the conventional method described above, however, regression analysis is employed for calculating the refrigerant amount. As numerous test parameters must be determined, application of an estimation formula takes much labor and time.

The refrigerant amount must be calculated in a state similar to an operation state where the test parameters have been determined. Therefore, apart from normal operation, special operation must be executed aimed at refrigerant amount calculation. As the purpose of the special operation is to improve the accuracy of refrigerant amount calculation, the air conditioning capability and efficiency may undesirably be decreased during the special operation.

The outdoor air temperature differs largely depending on the season and the installation location. When the refrigerant amount is to be calculated in accordance with the conventional method described above, even if the special operation is performed, it may be difficult to realize an estimated operation state. In this case, calculation of the refrigerant amount is performed in an operation which is as close as possible to the estimated operation state. Consequently, the refrigerant amount calculation accuracy changes depending on the installation location and seasonal factors.

In calculation of the refrigerant amount of the refrigerating circuit, the phenomenon is formulated under various assumptions. If a phenomenon such as uneven distribution of the outdoor air to the heat exchanger or of the refrigerant to the paths, which is difficult to anticipate occurs and the calculation trend differs from the actual measurement trend, sufficiently high calculation accuracy is difficult to obtain.

With the technical method described above, in calculation of the refrigerant amount, if a high-density refrigerant such as a liquid refrigerant or a high-pressure refrigerant exists in an element, e.g., a pipe that connects constituent devices, which is not considered particularly, the calculation accuracy decreases.

After the air conditioning apparatus is installed on the site, the air conditioning apparatus is charged with the refrigerant until reaching an appropriate refrigerant amount calculated from the pipe length, the volumes of the constituent elements, and the like. If a calculation error occurs in calculating the appropriate refrigerant amount or a charging operation error occurs, the appropriate refrigerant amount and the initially enclosed refrigerant amount which is the amount of refrigerant actually charged on the site may differ. According to the conventional method, the excess/shortage of the refrigerant mount is determined in spite that the initially enclosed refrigerant amount and the appropriate refrigerant amount differ. Consequently, the determination accuracy degrades.

Also, the conventional air conditioning apparatus employs the degree of supercooling of the refrigerant as the operation state amount based on which the refrigerant amount is to be detected. Hence, unless it is modified, the refrigerant amount calculation method cannot be applied to a refrigerating cycle apparatus that operates in a supercritical state and employs a $CO_2$ refrigerant the degree of supercooling of which cannot be obtained.

The present invention has been made to solve the above problems, and has as its object to accurately determine the excess/shortage of the refrigerant amount in a refrigerating cycle apparatus under any environmental condition and any installation condition depending on a difference in device system configuration of the refrigerating cycle apparatus, the pipe length and the pipe diameter, the difference in elevation at the time of installation, the number of indoor units to be connected, and the capacities of the indoor units, by storing an appropriate refrigerant amount in the refrigerating cycle apparatus, calculating a refrigerant amount based on refrigerating cycle characteristics obtained from the refrigerating cycle apparatus, and comparing the calculative refrigerant amount with the stored appropriate refrigerant amount.

It is also an object of the present invention to provide a refrigerating cycle apparatus that can accurately determine the excess/shortage of the refrigerant amount charged in a refrigerant cycle in the apparatus regardless of whether the apparatus is in the cooling/heating mode.

It is also an object of the present invention to provide a refrigerating cycle apparatus that accurately determines the excess/shortage of the refrigerant amount regardless of the type of the refrigerant.

It is also an object of the present invention to provide a refrigerating cycle apparatus that can accurately determine the excess/shortage of the refrigerant amount even if a phenomenon such as uneven distribution of the refrigerant in the paths, which is difficult to anticipate is present in the heat exchanger.

It is also an object of the present invention to provide a refrigerating cycle apparatus that can accurately determine the excess/shortage of the refrigerant amount in the refrigerating circuit even if a factor is present that renders difficult calculation of the refrigerant amount in the heat exchanger or the like.

Solution to Problem

A refrigerating cycle apparatus according to the present invention includes:

not less than one heat source unit having at least a compressor and a heat source side heat exchanger;

not less than one utilization unit having at least a pressure reducing device and a utilization side heat exchanger;

a refrigerating circuit formed by connecting the heat source unit and the utilization unit via a liquid connection pipe and a gas connection pipe;

a storage part that stores an appropriate refrigerant amount in the refrigerating circuit and a correction coefficient which corrects a liquid refrigerant amount so that calculation of a refrigerant amount of each constituent element of the refrigerating circuit and the appropriate refrigerant amount become equal to each other;

a measurement part that detects an operation state amount in each constituent element of the refrigerating circuit;

a calculation part that calculates the refrigerant amount of each constituent element of the refrigerating circuit based on the operation state amount by using the correction coefficient;

a comparison part that compares the appropriate refrigerant amount and a calculative refrigerant amount which is calculated by the calculation part; and a determination part that determines excess/shortage of a refrigerant amount charged in the refrigerating circuit based on a comparison result of the comparison part.

Advantageous Effects of Invention

The refrigerating cycle apparatus according to the present invention is advantageous in that it can accurately determine the excess/shortage of the refrigerant amount in the refrigerating cycle apparatus under any environmental condition and any installation condition, by calculating the refrigerant amount in the refrigeration circuit based on the operation state amount of the refrigerating cycle, and comparing the calculative refrigerant amount with an appropriate refrigerant amount stored in a storage part. As a result, a refrigerant cycle apparatus that is highly reliable and easy to maintain can be obtained.

DESCRIPTION OF EMBODIMENTS

Embodiment 1

Apparatus Configuration

Figure 1:
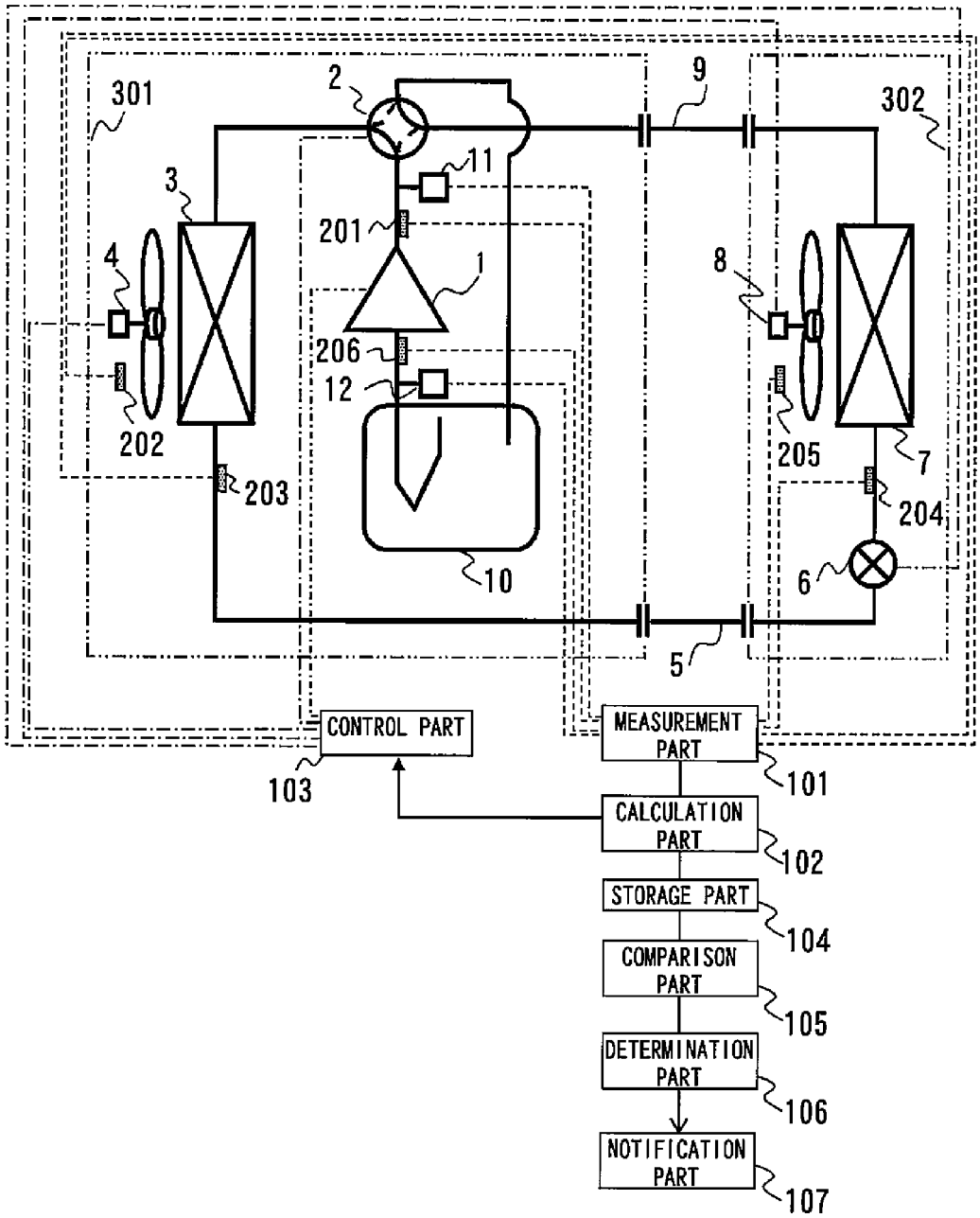
FIG. 1 is a schematic refrigerating circuit diagram of an air conditioning apparatus that employs a refrigerant amount determination system according to the first embodiment of the present invention.

FIG. 1 is a schematic refrigerating circuit diagram of an air conditioning apparatus (refrigerating cycle apparatus) that employs a refrigerant amount determination system according to the first embodiment of the present invention. The air conditioning apparatus is an apparatus used for cooling/heating an indoor space as it performs vapor compression type refrigerating cycle operation.

The air conditioning apparatus is at least provided with a heat source unit 301, a utilization unit 302, and a liquid connection pipe 5 and gas connection pipe 9 which serve as refrigerant connection pipes to connect the heat source unit 301 and utilization unit 302.

More specifically, a vapor compression type refrigerating circuit of the air conditioning apparatus of this embodiment is constituted by connecting the heat source unit 301, utilization unit 302, liquid connection pipe 5, and gas connection pipe 9.

Examples of the refrigerant used by the air conditioning apparatus include an HFC refrigerant such as R410A, R407C, or R404A, an HCFC refrigerant such as R22 or R134a, or a natural refrigerant such as hydrocarbon or helium.

<Utilization Unit 302>

The utilization unit 302 is installed by, e.g., embedding in or suspending from the room ceiling, or hanging on the wall surface. The utilization unit 302 is connected to the heat source unit 301 via the liquid connection pipe 5 and gas connection pipe 9, to constitute part of the refrigerating circuit.

The utilization unit 302 is provided with an indoor refrigerating circuit which forms part of the refrigerating circuit. The indoor refrigerating circuit is provided with a pressure reducing device 6, an indoor heat exchanger 7 serving as a utilization side heat exchanger, and an indoor blower 8 to supply conditioned air that has heat-exchanged with the refrigerant in the indoor heat exchanger 7, into the room.

In this embodiment, the pressure reducing device 6 is connected to the liquid side of the utilization unit 302 in order to perform, e.g., adjustment of the flow rate of the refrigerant flowing in the refrigerating circuit.

In this embodiment, for example, the indoor heat exchanger 7 is a cross-fin-type fin-and-tube heat exchanger composed of a heat transfer tube and a large number of fins. The indoor heat exchanger 7 is a heat exchanger that serves as a refrigerant evaporator in the cooling mode to cool indoor air, and as a refrigerant condenser in the heating mode to heat indoor air.

In this embodiment, the utilization unit 302 has the indoor blower 8 which, after the indoor air is taken by the unit and heat-exchanges with the indoor heat exchanger 7, supplies the heat-exchanged indoor air indoors as conditioned air. Thus, the indoor air and the refrigerant flowing in the indoor heat exchanger 7 can heat-exchange with each other.

The indoor blower 8 is capable of changing the flow rate of the conditioned air to be supplied to the indoor heat exchanger 7. The indoor blower 8 has a fan such as a centrifugal fan or multiblade fan, and a motor such as a DC fan motor which drives the fan.

The utilization unit 302 is provided with a sensor. More specifically, the liquid side of the indoor heat exchanger 7 is provided with a liquid-side temperature sensor 204 which detects the temperature of the liquid-state refrigerant (i.e., a supercooled liquid temperature $T_{sco}$) in the heating mode. The indoor air suction port side is provided with an indoor temperature sensor 205 which detects the temperature of the indoor air flowing into the unit. In this embodiment, the liquid-side temperature sensor 204 and indoor temperature sensor 205 respectively comprise thermistors.

The operations of the pressure reducing device 6 and indoor blower 8 are controlled by a control part 103 which serves as a normal operation control means for performing normal operation including the cooling mode and heating mode.

<Heat Source Unit 301>

The heat source unit 301 is installed outdoors, and connected to the utilization unit 302 via the liquid connection pipe 5 and gas connection pipe 9, to constitute the refrigerating circuit. Although this embodiment is exemplified by an air conditioning apparatus provided with one heat source unit 301 and one utilization unit 302, the air conditioning apparatus is not limited to this, but may be provided with a plurality of heat source units 301 and a plurality of utilization units 302.

The heat source unit 301 has an outdoor side refrigerating circuit which forms part of the refrigerating circuit. The outdoor side refrigerating circuit has a compressor 1, a four-way valve 2, an outdoor heat exchanger 3, an outdoor blower 4, and an accumulator 10. The compressor 1 compresses the refrigerant. The four-way valve 2 switches the refrigerant flowing direction. The outdoor heat exchanger 3 serves as a heat source side heat exchanger. The outdoor blower 4 blows air to the outdoor heat exchanger 3.

In this embodiment, the compressor 1 is a variable-operation-capacity compressor and is, for example, a positive-displacement compressor driven by a motor (not shown) controlled by an inverter. Although only one compressor 1 is connected in this embodiment, the present invention is not limited to this. Two or more compressors 1 may be connected in parallel to each other depending on the number of connected utilization units 302 or the like.

In this embodiment, the four-way valve 2 is a valve that switches the refrigerant flowing direction. In the cooling mode, the four-way valve 2 connects the discharge side of the compressor 1 to the gas side of the outdoor heat exchanger 3, and the suction side of the compressor 1 to the gas connection pipe 9 side, so that the outdoor heat exchanger 3 serves as the condenser for the refrigerant to be compressed in the compressor 1, and that the indoor heat exchanger 7 serves as the evaporator for the refrigerant to be condensed in the outdoor heat exchanger 3 (see the solid lines of the four-way valve 2 in FIG. 1).

In the heating mode, the discharge side of the compressor 1 can be connected to the gas connection pipe 9 side, and the suction side of the compressor 1 can be connected to the gas side of the outdoor heat exchanger 3, so that the indoor heat exchanger 7 serves as the condenser for the refrigerant to be compressed in the compressor 1, and that the outdoor heat exchanger 3 serves as the evaporator for the refrigerant to be condensed in the indoor heat exchanger 7 (see the broken lines of the four-way valve 2 in FIG. 1).

In this embodiment, for example, the outdoor heat exchanger 3 is a cross-fin-type fin-and-tube heat exchanger composed of a heat transfer tube and a large number of fins. The outdoor heat exchanger 3 is a heat exchanger that serves as a refrigerant condenser in the cooling mode, and as a refrigerant evaporator in the heating mode. The outdoor heat exchanger 3 is connected on its gas side to the four-way valve 2, and on its liquid side to the liquid connection pipe 5.

In this embodiment, the heat source unit 301 has the outdoor blower 4 which, after the outdoor air is taken by the unit and heat-exchanged by the outdoor heat exchanger 3, discharges the heat-exchanged outdoor air outdoors. Thus, the outdoor air and the refrigerant flowing in the outdoor heat exchanger 3 can heat-exchange with each other.

The outdoor blower 4 is capable of changing the flow rate of air to be supplied to the outdoor heat exchanger 3. The outdoor blower 4 includes a fan such as a propeller fan, and a motor such as a DC fan motor which drives the fan.

In this embodiment, the accumulator 10 is connected to the suction side of the compressor 1. Hence, if an abnormality occurs in the air conditioning apparatus or during transient response in an operation state which accompanies a change in operation control, the accumulator 10 accumulates the liquid refrigerant so as not to be flowing into the compressor 1.

The heat source unit 301 is provided with various types of sensors to be described below.

(1) a discharge temperature sensor 201 provided to the discharge side of the compressor 1 to detect a discharge temperature $T_d$ (2) a liquid-side temperature sensor 203 provided to the liquid side of the outdoor heat exchanger 3 to detect the temperature of the liquid refrigerant (3) an outdoor temperature sensor 202 provided to the outdoor air suction port side of the heat source unit 301 to detect the temperature of the outdoor air (that is, an outdoor air temperature $T_{cai}$) flowing into the unit (4) a discharge pressure sensor 11 (high pressure detection device) provided to the discharge side of the compressor 1 to detect a discharge pressure $P_d$ (5) a suction pressure sensor 12 (low pressure detection device) provided to the suction side of the compressor 1 to detect a suction pressure $P_s$ The compressor 1, four-way valve 2, and outdoor blower 4 are controlled by the control part 103.

The respective values detected by the various types of temperature sensors described above are input to a measurement part 101 and processed by a calculation part 102. Based on the processing result of the calculation part 102, the control part 103 controls the compressor 1, four-way valve 2, outdoor blower 4, pressure reducing device 6, and indoor blower 8, so that the respective values detected by the various types of temperature sensors described above fall within desired control target ranges.

The compressor 1, four-way valve 2, outdoor blower 4, pressure reducing device 6, indoor blower 8, and the like which are controlled by the control part 103 will be defined as the respective constituent devices of the heat source unit and utilization unit.

The calculation part 102 calculates the refrigerant amount based on the operation state amounts obtained by the measurement part 101. The calculative refrigerant amount is stored in a storage part 104. A comparison part 105 compares the calculative refrigerant amount with an appropriate apparatus refrigerant amount stored in advance in the storage part 104. Based on the comparison result, a determination part 106 determines the excess/shortage of the refrigerant amount of the air conditioning apparatus. A notification part 107 notifies the determination result to a display device (not shown) such as an LED or a remote location monitor.

As described above, the heat source unit 301 and utilization unit 302 are connected via the liquid connection pipe 5 and gas connection pipe 9, to constitute the refrigerating circuit of the air conditioning apparatus.

The operation of the air conditioning apparatus of this embodiment will now be described.

The operation of the air conditioning apparatus of this embodiment includes "normal operation" in which the respective devices of the heat source unit 301 and utilization unit 302 are controlled depending on the operation load of the utilization unit 302. The normal operation includes at least the cooling mode and heating mode.

The operation of the air conditioning apparatus in each operation mode will be described hereinafter.

<Normal Operation>

First, the cooling mode will be described with reference to FIG. 1.

In the cooling mode, the four-way valve 2 is in the state indicated by the solid lines in FIG. 1. Namely, the discharge side of the compressor 1 is connected to the gas side of the outdoor heat exchanger 3, and the suction side of the compressor 1 is connected to the gas side of the indoor heat exchanger 7.

The pressure reducing device 6 is controlled by the control part 103 to have such a degree of opening that the degree of superheating of the refrigerant on the suction side of the compressor 1 is of a predetermined value.

In this embodiment, the degree of superheating of the refrigerant during suction by the compressor 1 is obtained by first calculating an evaporation temperature $T_e$ of the refrigerant based on the compressor suction pressure $P_s$ detected by the suction pressure sensor 12, and then subtracting the evaporation temperature $T_e$ of the refrigerant from a suction temperature $T_s$ of the refrigerant detected by a suction temperature sensor 206.

Alternatively, the indoor heat exchanger 7 may be provided with a temperature sensor to detect the evaporation temperature $T_e$. The degree of superheating of the refrigerant may be detected by subtracting the evaporation temperature $T_e$ from the suction temperature $T_s$ of the refrigerant.

In this state of the refrigerating circuit, when the compressor 1, outdoor blower 4, and indoor blower 8 are started, the low-pressure gas refrigerant is taken by the compressor 1 and compressed, to become a high-pressure gas refrigerant. After that, the high-pressure gas refrigerant is supplied to the outdoor heat exchanger 3 via the four-way valve 2, and is condensed as it heat-exchanges with the outdoor air supplied by the outdoor blower 4, to become a high-pressure liquid refrigerant.

The high-pressure liquid refrigerant is sent to the utilization unit 302 via the liquid connection pipe 5. The high-pressure liquid refrigerant is pressure-reduced by the pressure reducing device 6 to become a low-temperature, low-pressure gas-liquid two-phase refrigerant. The refrigerant is then evaporated as it is heat-exchanged with the indoor air by the indoor heat exchanger 7, to become a low-pressure gas refrigerant.

The pressure reducing device 6 controls the flow rate of the refrigerant flowing in the indoor heat exchanger 7 such that the degree of superheating during suction by the compressor 1 is of a predetermined value. Therefore, the low-pressure gas refrigerant evaporated in the indoor heat exchanger 7 has a predetermined degree of superheating. In this manner, a refrigerant flows in the indoor heat exchanger 7 at a flow rate corresponding to the operation load required by the air-conditioned space where the utilization unit 302 is installed.

The low-pressure gas refrigerant is sent to the heat source unit 301 via the gas connection pipe 9. After it passes through the accumulator 10 via the four-way valve 2, the low-pressure gas refrigerant is taken by the compressor 1 again.

The heating mode will now be described.

In the heating mode, the four-way valve 2 is in the state indicated by the broken lines in FIG. 1. Namely, the discharge side of the compressor 1 is connected to the gas side of the indoor heat exchanger 7, and the suction side of the compressor 1 is connected to the gas side of the outdoor heat exchanger 3.

The pressure reducing device 6 is controlled by the control part 103 to have such a degree of opening that the degree of superheating of the refrigerant on the suction side of the compressor 1 is of a predetermined value.

In this embodiment, the degree of superheating of the refrigerant during suction by the compressor 1 is obtained by first calculating the evaporation temperature $T_e$ of the refrigerant based on the compressor suction pressure $P_s$ detected by the suction pressure sensor 12, and then subtracting the evaporation temperature $T_e$ of the refrigerant from the suction temperature $T_s$ of the refrigerant detected by the suction temperature sensor 206.

Alternatively, the outdoor heat exchanger 3 may be provided with a temperature sensor to detect the evaporation temperature $T_e$. The degree of superheating of the refrigerant may be detected by subtracting the evaporation temperature $T_e$ from the suction temperature $T_s$ of the refrigerant.

In this state of the refrigerating circuit, when the compressor 1, outdoor blower 4, and indoor blower 8 are started, the low-pressure gas refrigerant is taken by the compressor 1 and compressed, to become a high-pressure gas refrigerant. The high-pressure gas refrigerant is supplied to the utilization unit 302 via the four-way valve 2 and gas connection pipe 9.

The high-pressure gas refrigerant sent to the utilization unit 302 is condensed as it heat-exchanges with the indoor air in the indoor heat exchanger 7, to become a high-pressure liquid refrigerant. The high-pressure liquid refrigerant is then pressure-reduced by the pressure reducing device 6 to become a low-pressure gas-liquid two-phase refrigerant.

The pressure reducing device 6 controls the flow rate of the refrigerant flowing in the indoor heat exchanger 7 such that the degree of superheating during suction by the compressor 1 is of a predetermined value. Therefore, the high-pressure liquid refrigerant condensed in the indoor heat exchanger 7 has a predetermined degree of superheating. In this manner, a refrigerant flows in the indoor heat exchanger 7 at a flow rate corresponding to the operation load required by the air-conditioned space where the utilization unit 302 is installed.

The low-pressure gas-liquid two-phase refrigerant flows into the outdoor heat exchanger 3 of the heat source unit 301 via the liquid connection pipe 5. The low-pressure gas-liquid two-phase refrigerant flowing into the outdoor heat exchanger 3 evaporates as it heat-exchanges with the outdoor air supplied by the outdoor blower 4, to become a low-pressure gas refrigerant. After it passes through the accumulator 10 via the four-way valve 2, the low-pressure gas refrigerant is taken by the compressor 1 again.

In this manner, the control part 103 serving as the normal operation control means which performs the normal operation including the cooling mode and heating mode performs the normal operation process including the cooling mode and heating mode described above.

In the normal operation, the control part 103 performs control such that the degree of superheating of the refrigerant at the suction side and discharge side of the compressor 1 and the degree of supercooling of the refrigerant at the outlet side of the condenser (the outdoor heat exchanger 3 in the cooling mode and the indoor heat exchanger 7 in the heating mode) are each larger than 0 degree.

A refrigerant amount excess/shortage determination method in this embodiment will be described based on the cooling mode. Being in the cooling mode, the indoor heat exchanger 7 of the utilization unit 302 operates as the evaporator, and the outdoor heat exchanger 3 of the heat source unit 301 operates as the condenser. In the heating mode as well, the refrigerant amount can be calculated in accordance with the same method by excluding the liquid connection pipe 5.

First, a method will be described, of calculating the refrigerant amount existing in the refrigerating circuit by calculating the refrigerant amounts of the respective constituent elements based on the operation state amounts of the respective constituent elements which constitute the refrigerating circuit. The liquid refrigerant amount is corrected to obtain the refrigerant amount.

Then, the influence exercised on the calculative refrigerant amount by correction of the liquid refrigerant amount, and a procedure for correcting the liquid refrigerant amount, of this embodiment will be described. After that, a method will be described, of detecting the excess/shortage of the refrigerant amount by comparing the calculative refrigerant amount and an appropriate refrigerant amount.

Note that in this specification, symbols used in the numerical expressions will be followed by their units in [ ] as they first appear in this specification. A symbol that is nondimensional (having no unit) will be followed by [-].

<Method of Calculating Refrigerant Amount>

As shown in the following expression, a calculative refrigerant amount $M_r$ [kg] is obtained by calculating the refrigerant amounts of the respective constituent elements that constitute the refrigerating circuit based on the operation states of the respective elements, and calculating the sum of the respective refrigerant amounts.

[Numerical Expression 1]

$$M_r=\Sigma(V\times\rho) \tag{1}$$

It is supposed that most of the refrigerant exists in an element having a large internal volume V [$m^3$] or an element having a high average refrigerant density ρ [$kg/m^3$], and in a refrigerating machine oil. In this embodiment, the refrigerant amount is calculated considering the element having a large internal volume V or the element having a high average refrigerant density ρ, and the refrigerating machine oil. The element having the high average refrigerant density ρ refers to an element having a high pressure, or an element through which a two-phase or liquid-phase refrigerant passes.

In this embodiment, the calculative refrigerant amount $M_r$ [kg] is obtained considering the outdoor heat exchanger 3, the liquid connection pipe 5, the indoor heat exchanger 7, the gas connection pipe 9, the accumulator 10, and the refrigerating machine oil existing in the refrigerating circuit. The calculative refrigerant amount $M_r$ is expressed as the sum of the products each obtained by multiplication of the internal volume V of each element by the average refrigerant density ρ, as indicated by expression (1).

Figure 2:
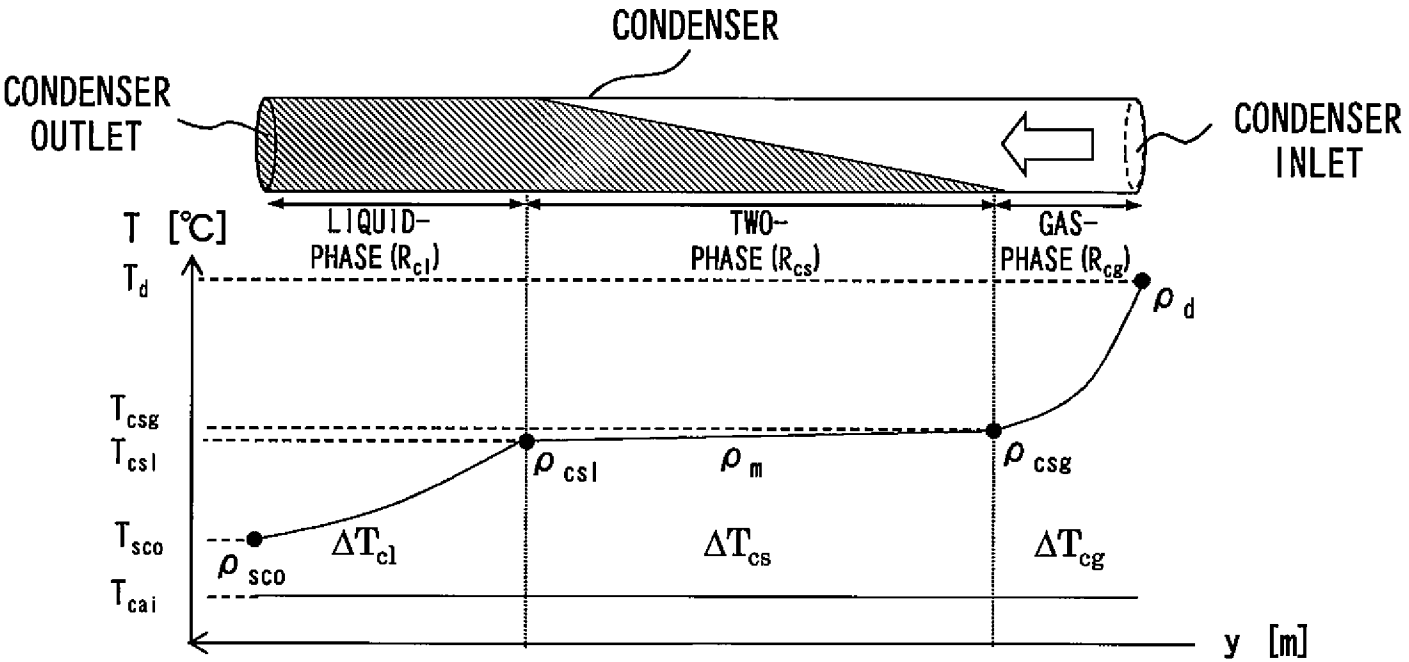
FIG. 2 is a schematic graph showing a state of a refrigerant in a condenser of the first embodiment of the present invention.

The outdoor heat exchanger 3 serves as a condenser. FIG. 2 shows the state of the refrigerant in the condenser. Since the degree of superheating on the discharge side of the compressor 1 is larger than 0, the refrigerant is of a gas phase at the inlet of the condenser. At the outlet of the condenser, since the degree of supercooling is larger than 0, the refrigerant is of a liquid phase. In the condenser, a gas-phase temperature-$T_d$ refrigerant is cooled by the temperature-$T_{cai}$ outdoor air to become a temperature-$T_{csg}$ saturated vapor. The saturated vapor is condensed by a latent heat change in the two-phase state to become a temperature-$T_{csl}$ saturated liquid. The saturated liquid is further cooled to be of a temperature-$T_{sco}$ liquid phase.

A condenser refrigerant amount $M_{r,c}$ [kg] is expressed by the following expression.

[Numerical Expression 2]

$$M_{r,c}=V_c\times\rho_c \tag{2}$$

A condenser internal volume $V_c$ [$m^3$] is known because it is an apparatus specification. An average refrigerant density $\rho_c$ [$kg/m^3$] of the condenser is expressed by the following expression.

[Numerical Expression 3]

$$\rho_c=R_{cg}\times\rho_{cg}+R_{cs}\times\rho_{cs}+R_{cl}\times\rho_{cl} \tag{3}$$

Note that $R_{cg}$[-], $R_{cs}$ [-], and $R_{cl}$[-] represent gas-phase, two-phase, and liquid-phase volumetric proportions, respectively, and that $\rho_{cg}$ [$kg/m^3$], $\rho_{cs}$ [$kg/m^3$], and $\rho_{cl}$ [$kg/m^3$] represent gas-phase, two-phase, and liquid-phase average refrigerant densities, respectively. In order to calculate the average refrigerant density of the condenser, the volumetric proportion and average refrigerant density of each phase must be calculated.

First, a method of calculating the average refrigerant density of each phase will be described.

The gas-phase average refrigerant density $\rho_{cg}$ in the condenser is, for example, obtained as the average value of a condenser inlet density $\rho_d$ [$kg/m^3$] and a saturated vapor density $\rho_{csg}$ [$kg/m^3$] in the condenser.

[Numerical Expression 4]

$$\rho_{cg} = \frac{\rho_d + \rho_{csg}}{2} \tag{4}$$

The condenser inlet density $\rho_d$ can be calculated based on the condenser inlet temperature (corresponding to the discharge temperature $T_d$) and the pressure (corresponding to the discharge pressure $P_d$). The saturated vapor density $\rho_{csg}$ in the condenser can be calculated based on the condensing pressure (corresponding to the discharge pressure $P_d$). The liquid-phase average refrigerant density $\rho_{cl}$ is obtained as, e.g., the average value of a condenser-outlet density $\rho_{sco}$ [kg/m$^3$] and saturated liquid density $\rho_{csl}$ [kg/m$^3$] in the condenser.

[Numerical Expression 5]

$$\rho_{cl} = \frac{\rho_{sco} + \rho_{csl}}{2} \tag{5}$$

The condenser outlet density $\rho_{sco}$ can be calculated based on the condenser outlet temperature $T_{sco}$ and the pressure (corresponding to the discharge pressure $P_d$). The saturated liquid density $\rho_{csl}$ in the condenser can be calculated based on the condensing pressure (discharge pressure $P_d$).

Assuming that the heat flux is constant in the two-phase range, the two-phase average refrigerant density $\rho_{cs}$ in the condenser is expressed by the following expression.

[Numerical Expression 6]

$$\rho_{cs} = \int_0^1 [f_{cg} \times \rho_{csg} + (1 - f_{cg}) \times \rho_{csl}] dx \tag{6}$$

Note that x [-] represents the dryness degree of the refrigerant and $f_{cg}$ [-] represents the void fraction in the condenser, which are expressed by the following expression.

[Numerical Expression 7]

$$f_{cg} = \frac{1}{1 + \left(\frac{1}{x} - 1\right)\frac{\rho_{csg}}{\rho_{csl}} s} \tag{7}$$

Note that s [-] represents the slip ratio. Many experimental expressions have previously been proposed so far as the calculating expressions of the slip ratio s. The slip ratio s is expressed as a function of a mass flux $G_{mr}$ [kg/(m$^2$s)], the condensing pressure (corresponding to the discharge pressure $P_d$), and the dryness degree x.

[Numerical Expression 8]

$$s = f(G_{mr}, P_d, X) \tag{8}$$

The mass flux $G_{mr}$ changes depending on the operation frequency of the condenser. By calculating the slip ratio s using this method, a change in calculative refrigerant amount $M_r$ for the operation frequency of the compressor 1 can be detected.

The mass flux $G_{mr}$ can be obtained based on the refrigerant flow rate in the condenser.

The air conditioning apparatus of this embodiment is provided with the outdoor heat exchanger 3 (heat source side heat exchanger) or indoor heat exchanger 7 (utilization side heat exchanger), and a refrigerant flow rate calculation part which calculates the refrigerant flow rate. By using the slip ratio s, the refrigerant flow rate calculation part can detect a change in calculative refrigerant amount $M_r$ in the outdoor heat exchanger 3 or indoor heat exchanger 7 with respect to the flow rate of the refrigerant flowing in the outdoor heat exchanger 3 or indoor heat exchanger 7, for the operation frequency of the compressor 1.

A method of calculating the volumetric proportion of each phase will be described. The volumetric proportion is expressed by the ratio of the heat transfer area, and accordingly the following expression is obtained.

[Numerical Expression 9]

$$R_{cg}:R_{cs}:R_{cl} = \frac{A_{cg}}{A_c}:\frac{A_{cs}}{A_c}:\frac{A_{cl}}{A_c} \tag{9}$$

Note that $A_{cg}$ [m$^2$], $A_{cs}$ [m$^2$], and $A_{cl}$ [m$^2$] are gas-phase, two-phase, and liquid-phase heat transfer areas, respectively, in the condenser, and that $A_c$ [m$^2$] is the heat transfer area of the condenser. Also note that the specific enthalpy difference in each of the gas-phase region, two-phase region, and liquid-phase region in the condenser is defined as ΔH [kJ/kg] and that the average temperature difference between the refrigerant and a medium that heat-transfers with the refrigerant is defined as $\Delta T_m$. The following expression is obtained for each phase because of the heat balance.

[Numerical Expression 10]

$$G_r \times \Delta H = AK\Delta T \tag{10}$$

Note that $G_r$ [kg/h] is the mass flow rate of the refrigerant, A [m$^2$] is the heat transfer area, and K [kw/(m$^{2\circ}$ C.)] is the heat transmission coefficient. Assuming that the heat transmission coefficient K of each phase is constant, the volumetric proportion is proportional to a value obtained by dividing the specific enthalpy difference ΔH [kJ/kg] by a temperature difference ΔT between the refrigerant and outdoor air.

However, depending on the wind velocity distribution, in each path, a location not exposed to the wind may have less liquid phase, and a location likely to be exposed to the wind may have more liquid phase because heat transfer is promoted. Also, the refrigerant may exist non-uniformly because of the uneven distribution of the paths of the refrigerant. Hence, when calculating the volumetric proportion of each phase, the above phenomenon is corrected by multiplying the liquid phase part by a condenser liquid-phase proportion correction coefficient α [-]. From the foregoing, the following expression is derived.

[Numerical Expression 11]

$$R_{cg}:R_{cs}:R_{cl} = \frac{\Delta H_{cg}}{\Delta T_{cg}}:\frac{\Delta H_{cs}}{\Delta T_{cs}}:\alpha\frac{\Delta H_{cl}}{\Delta T_{cl}} \tag{11}$$

Note that $\Delta H_{cg}$ [kJ/kg], $\Delta H_{cs}$ [kJ/kg], and $\Delta H_{cl}$ [kJ/kg] are gas-phase, two-phase, and liquid-phase refrigerant specific enthalpy differences, respectively, and that $\Delta T_{cg}$ [° C.], $\Delta T_{cs}$ [° C.], and $\Delta T_{cl}$[° C.] are temperature differences between the respective phases and the outdoor temperature.

The condenser liquid-phase proportion correction coefficient $\alpha$ is a value obtained based on the measurement data and changes depending on the device specification, particularly the condenser specification.

Using the condenser liquid-phase proportion correction coefficient $\alpha$, the proportion of the liquid-phase refrigerant existing in the condenser can be corrected based on the operation state amount of the condenser.

$\Delta H_{cg}$ is obtained by subtracting the specific enthalpy of the saturated vapor from the specific enthalpy at the condenser inlet (corresponding to the discharge specific enthalpy of the compressor 1). The discharge specific enthalpy is obtained by calculating the discharge pressure $P_d$ and the discharge temperature $T_d$. The specific enthalpy of the saturated vapor in the condenser can be calculated based on the condensing pressure (corresponding to the discharge pressure $P_d$).

$\Delta H_{cs}$ is obtained by subtracting the specific enthalpy of the saturated liquid in the condenser from the specific enthalpy of the saturated vapor in the condenser. The specific enthalpy of the saturated liquid in the condenser can be calculated based on the condensing pressure (corresponding to the discharge pressure $P_d$).

$\Delta H_{cl}$ can be obtained by subtracting the specific enthalpy at the condenser outlet from the specific enthalpy of the saturated liquid in the condenser. The specific enthalpy at the condenser outlet can be obtained by calculating the condensing pressure (corresponding to the discharge pressure $P_d$) and the condenser outlet temperature $T_{sco}$.

The temperature difference $\Delta T_{cg}$ [° C.] between the outdoor air and the gas phase in the condenser can be expressed as a logarithmic average temperature difference by the following expression by employing a condenser inlet temperature (corresponding to the discharge temperature $T_d$), the saturated vapor temperature $T_{csg}$ [° C.] in the condenser, and the inlet temperature $T_{cai}$ [° C.] of the outdoor air.

[Numerical Expression 12]

$$\Delta T_{cg} = \frac{(T_d - T_{cai}) - (T_{csg} - T_{cai})}{\ln\frac{(T_d - T_{cai})}{(T_{csg} - T_{cai})}} \tag{12}$$

The saturated vapor temperature $T_{csg}$ in the condenser can be calculated based on the condensing pressure (corresponding to the discharge pressure $P_d$). The average temperature difference $\Delta T_{cs}$ between the two-phase part and the outdoor air is expressed by the following expression by employing the saturated vapor temperature $T_{csg}$ and saturated liquid temperature $T_{csl}$ in the condenser.

[Numerical Expression 13]

$$\Delta T_{cs} = \frac{T_{csg} + T_{csl}}{2} - T_{cai} \tag{13}$$

The saturated liquid temperature $T_{csl}$ in the condenser can be calculated based on the condensing pressure (corresponding to the discharge pressure $P_d$). The average temperature difference $\Delta T_{cl}$ between the liquid-phase part and the outdoor air can be expressed as a logarithmic average temperature difference by the following expression by employing the condenser outlet temperature $T_{sco}$, the saturated liquid temperature $T_{csl}$ in the condenser, and the inlet temperature $T_{cai}$ of the outdoor air.

[Numerical Expression 14]

$$\Delta T_{cl} = \frac{(T_{csl} - T_{cai}) - (T_{sco} - T_{cai})}{\ln\frac{(T_{csl} - T_{cai})}{(T_{sco} - T_{cai})}} \tag{14}$$

From the foregoing, the average refrigerant density and volumetric proportion in each phase can be calculated, so that the average refrigerant density $\rho_c$ in the condenser can be calculated.

A liquid connection pipe refrigerant amount $M_{r,PL}$ [kg] and a gas connection pipe refrigerant amount $M_{r,PG}$ [kg] can be expressed by the following expressions, respectively.

[Numerical Expression 15]

$$M_{r,PL} = V_{PL} \times \rho_{PL} \tag{15}$$

[Numerical Expression 16]

$$M_{r,PG} = V_{PG} \times \rho_{PG} \tag{16}$$

Note that $\rho_{PL}$ [kg/m$^3$] is a liquid connection pipe average refrigerant density, and is obtained by calculating, e.g., the liquid connection pipe inlet temperature (corresponding to the condenser outlet temperature $T_{sco}$) and the liquid connection pipe inlet pressure (corresponding to the discharge pressure $P_d$).

In the heating operation, the refrigerant in the liquid connection pipe 5 is in the gas-liquid two-phase state, so $\rho_{PL}$ is expressed by the following expressions by employing a dryness degree $x_{ei}$ [-] at the evaporator inlet.

[Numerical Expression 17]

$$\rho_{PL} = \rho_{esg} x_{ei} + \rho_{esl}(1 - x_{ei}) \tag{17}$$

[Numerical Expression 18]

$$x_{ei} = \frac{H_{ei} - H_{esl}}{H_{esg} - H_{esl}} \tag{18}$$

Note that $\rho_{esg}$ [kg/m$^3$] and $\rho_{esl}$ [kg/m$^3$] are a saturated vapor density and a saturated liquid density, respectively, in the evaporator, and can be calculated based on the evaporating pressure (corresponding to the suction pressure $P_s$). $H_{esg}$ [kJ/kg] and $H_{esl}$ [kJ/kg] are a saturated vapor specific enthalpy and a saturated liquid specific enthalpy, respectively, in the evaporator, and are respectively obtained by calculating the evaporating pressure (corresponding to the suction pressure $P_s$). $H_{ei}$ is an evaporator inlet specific enthalpy and can be calculated based on the condenser outlet temperature $T_{sco}$.

Note that $\rho_{PG}$ [kg/m$^3$] is a gas connection pipe average refrigerant density, and can be obtained by calculating, e.g., the gas connection pipe outlet temperature (corresponding to the suction temperature $T_s$) and the gas connection pipe outlet pressure (corresponding to the suction pressure $P_s$).

$V_{PL}$ [m$^3$] and $V_{PG}$ [m$^3$] are a liquid connection pipe internal volume and a gas connection pipe internal volume, respectively. These values are known if the refrigerating cycle apparatus is a newly installed one or past installation information is held, because pipe length information can be acquired. These values are unknown if past installation information has been disposed of, because pipe length information cannot be acquired.

If pipe length information cannot be acquired, test operation is carried out after the apparatus is installed. A refrigerant amount $M_r''$ [kg] except for the liquid connection pipe and gas connection pipe is calculated based on the operation state amount of the refrigerating circuit. The total refrigerant amount $M_r$ of the liquid connection pipe 5 and gas connection pipe 9 is calculated by subtracting the refrigerant amount $M_r''$, which is calculated previously, from an appropriate refrigerant amount $M_r'$ [kg].

Assuming that a length L [m] of the liquid connection pipe 5 and that of the gas connection pipe 9 are equal, the pipe length L [m] can be calculated based on sectional areas $A_{PL}$ [$m^2$] and $A_{PG}$ [$m^2$] of the liquid connection pipe 5 and gas connection pipe 9, respectively, and the average refrigerant densities $\rho_{PL}$ [$kg/m^3$] and $\rho_{PG}$ [$kg/m^3$] in the liquid connection pipe 5 and gas connection pipe 9, respectively, in accordance with the following expression.

[Numerical Expression 19]

$$L = \frac{M_r' - M_r''}{A_{PL} \times \rho_{PL} + A_{PG} \times \rho_{PG}} \tag{19}$$

The liquid connection pipe internal volume $V_{PL}$ and the gas connection pipe internal volume $V_{PG}$ can be calculated based on the pipe lengths L [m].

As the average refrigerant density $\rho_{PL}$ in the liquid connection pipe 5 changes in accordance with the temperature, the heat dissipation loss in the liquid connection pipe 5 influences the calculation of the refrigerant amount. By adding temperature sensors on the upstream side and downstream side of the liquid connection pipe 5 and treating the average value of the two temperature sensors as the temperature of the liquid connection pipe 5, the refrigerant amount calculation precision can be improved.

As the average refrigerant density $\rho_{PG}$ in the gas connection pipe 9 changes in accordance with the pressure, the pressure loss in the gas connection pipe 9 influences the calculation of the refrigerant amount. The refrigerant amount calculation precision can be improved by adding pressure sensors on the upstream side and downstream side of the gas connection pipe 9 and treating the average value of the two pressure sensors as the pressure of the gas connection pipe 9.

Figure 3:
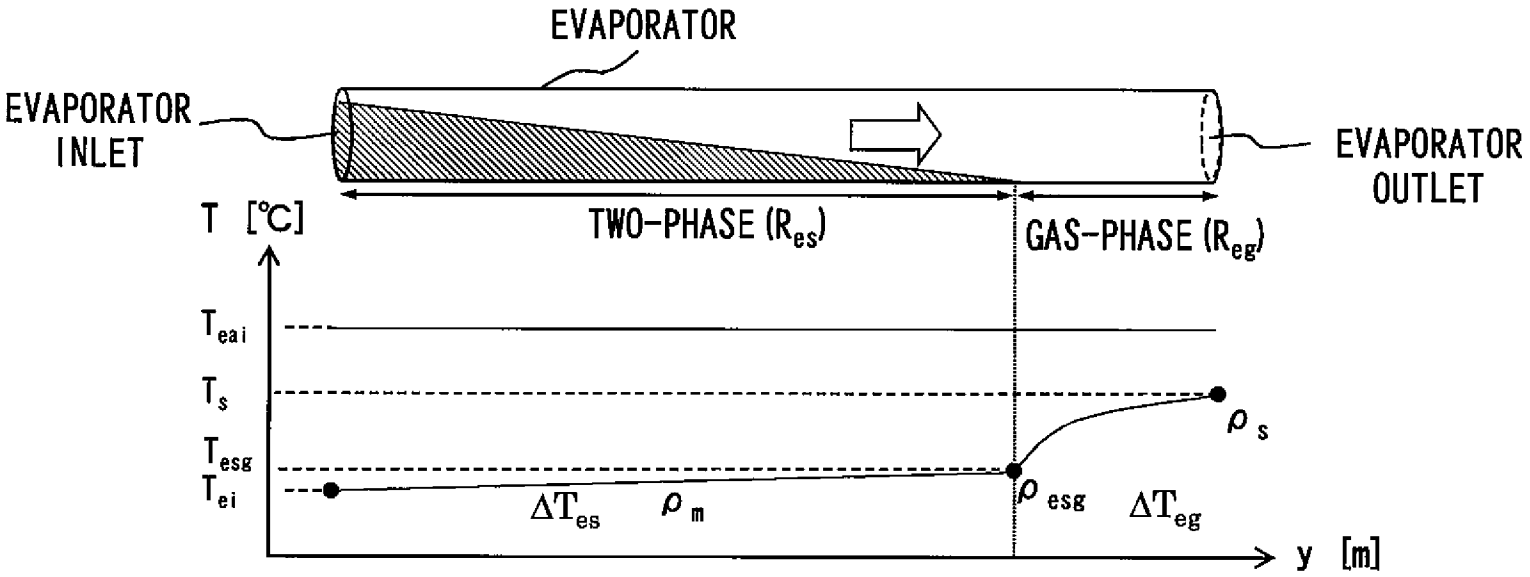
FIG. 3 is a schematic graph showing a state of the refrigerant in an evaporator of the first embodiment of the present invention.

The indoor heat exchanger 7 serves as the evaporator. FIG. 3 shows the state of the refrigerant in the evaporator. At the inlet of the evaporator, the refrigerant is in the two-phase state. At the outlet of the evaporator, the refrigerant is in the gas-phase state as the degree of superheating of the compressor 1 on the suction side is higher than 0. At the inlet of the evaporator, the refrigerant in the two-phase state having temperature $T_{ei}$ [° C.] is heated by the indoor suction air having temperature $T_{eai}$ [° C.], to become saturated vapor having temperature $T_{esg}$ [° C.], and is further heated to be in the gas-phase state of temperature $T_s$ [° C.]. The evaporator refrigerant amount $M_{r,e}$ [kg] is expressed by the following expression.

[Numerical Expression 20]

$$M_{r,e} = V_e \times \rho_e \tag{20}$$

Note that $V_e$ [$m_3$] represents the evaporator internal volume and is known because it is a device specification. $\rho_e$ is an evaporator average refrigerant density [$kg/m^3$] and is expressed by the following expression.

[Numerical Expression 21]

$$\rho_e = R_{es} \times \rho_{es} + R_{eg} \times \rho_{eg} \tag{21}$$

Note that $R_{es}$ [-] and $R_{eg}$ [-] represent the two-phase volumetric proportion and gas-phase volumetric proportion, respectively, and $\rho_{es}$ [$kg/m^3$] and $\rho_{eg}$ [$kg/m^3$] represent the two-phase average refrigerant density and gas-phase average refrigerant density, respectively. To calculate the average refrigerant density in the evaporator, the volumetric proportions and average refrigerant densities of the respective phases need be calculated.

First, how to calculate the average refrigerant density will be explained. Assuming that the heat flux is constant in the two-phase range, the two-phase average refrigerant density $\rho_{es}$ in the evaporator is expressed by the following expression.

[Numerical Expression 22]

$$\rho_{es} = \int_{xei}^{1} [f_{eg} \times \rho_{esg} + (1 - f_{eg}) \times \rho_{esl}] dx \tag{22}$$

Note that x [-] represents the dryness degree of the refrigerant and $f_{eg}$ [-] represents the void fraction in the evaporator, which are expressed by the following expression.

[Numerical Expression 23]

$$f_{eg} = \frac{1}{1 + \left(\frac{1}{x} - 1\right)\frac{\rho_{esg}}{\rho_{esl}} s} \tag{23}$$

Note that s [-] represents the slip ratio. Many experimental expressions have previously been proposed so far as the calculating expressions of the slip ratio s. The slip ratio s is expressed as a function of the mass flux $G_{mr}$ [$kg/(m^2s)$], the suction pressure $P_s$, and the dryness degree x.

[Numerical Expression 24]

$$S = f(G_{mr}, P_s, X) \tag{24}$$

The mass flux $G_{mr}$ changes in accordance with the operation frequency of the compressor 1. By calculating the slip ratio s using this method, a change in calculative refrigerant amount $M_r$ with respect to the operation frequency of the compressor 1 can be detected.

The mass flux $G_{mr}$ can be obtained based on the refrigerant flow rate in the evaporator.

The gas-phase average refrigerant density $\rho_{es}$ in the evaporator is obtained as, e.g., the average value of the saturated vapor density $\rho_{esg}$ in the evaporator and the evaporator outlet density $\rho_s$ [$kg/m^3$].

[Numerical Expression 25]

$$\rho_{eg} = \frac{\rho_{esg} + \rho_s}{2} \tag{25}$$

The saturated vapor density $\rho_{esg}$ in the evaporator can be calculated based on the evaporating pressure (corresponding to the suction pressure $P_s$). The evaporator outlet density (corresponding to the suction density $\rho_s$) can be calculated based on the evaporator outlet temperature (corresponding to the suction temperature $T_s$) and the pressure (corresponding to the suction pressure $P_s$).

How to calculate the volumetric proportion of each phase will be described. The volumetric proportion is expressed by the ratio of the heat transfer areas, and accordingly the following expression is established.

[Numerical Expression 26]

$$R_{es}:R_{eg} = \frac{A_{es}}{A_e}:\frac{A_{eg}}{A_e} \tag{26}$$

Note that $A_{es}$ [$m^2$] and $A_{eg}$ [$m^2$] are two-phase and gas-phase heat transfer areas, respectively, in the evaporator, and that $A_e$ [$m^2$] is the heat transfer area of the evaporator. Also, note that the specific enthalpy difference in each of the two-phase region and gas-phase region is defined as ΔH and that the average temperature difference between the refrigerant and a medium that heat-changes with the refrigerant is defined as $\Delta T_m$. The following expression is established for each phase based on the heat balance.

[Numerical Expression 27]

$$G_r \times \Delta H = AK\Delta T_m \tag{27}$$

Note that $G_r$ [kg/h] is the mass flow rate of the refrigerant, A [$m^2$] is the heat transfer area, and K is the heat transmission coefficient [kw/($m^{2\circ}$ C.)]. Assuming that the heat transmission coefficient K of each phase is constant, the volumetric proportion is proportional to a value obtained by dividing the specific enthalpy difference ΔH [kJ/kg] by a temperature difference ΔT [° C.] between the refrigerant and outdoor air. Hence, the following proportional expression is established.

[Numerical Expression 28]

$$R_{es}:R_{eg} = \frac{\Delta H_{es}}{\Delta T_{es}}:\frac{\Delta H_{eg}}{\Delta T_{eg}} \tag{28}$$

Note that $\Delta H_{es}$ [kJ/kg] and $\Delta H_{eg}$ [kJ/kg] are two-phase and gas-phase refrigerant specific enthalpy differences, respectively, and that $\Delta T_{es}$ [° C.] and $\Delta T_{eg}$ [° C.] are average temperature differences between the respective phases and the indoor temperature.

$\Delta H_{es}$ is obtained by subtracting the specific enthalpy at the evaporator inlet from the specific enthalpy of the saturated vapor in the evaporator. The specific enthalpy of the saturated vapor in the evaporator is obtained by calculating the evaporating pressure (corresponding to the suction pressure $P_s$). The evaporator inlet specific enthalpy can be calculated based on the condenser outlet temperature $T_{sco}$.

$\Delta H_{eg}$ is obtained by subtracting the specific enthalpy of the saturated vapor in the evaporator from the specific enthalpy at the evaporator outlet (corresponding to the suction specific enthalpy). The specific enthalpy at the evaporator outlet can be obtained by calculating the outlet temperature (corresponding to the suction temperature $T_s$) and the pressure (corresponding to the suction pressure $P_s$).

The average temperature difference $\Delta T_{es}$ between the two-phase refrigerant in the evaporator and the indoor air is expressed by the following expression.

[Numerical Expression 29]

$$\Delta T_{es} = T_{eai} - \frac{T_{esg} + T_{ei}}{2} \tag{29}$$

The saturated vapor temperature $T_{esg}$ in the evaporator is obtained by calculating the evaporating pressure (corresponding to the suction pressure $P_s$). The evaporator inlet temperature $T_{ei}$ can be calculated based on the evaporating pressure (corresponding to the suction pressure $P_s$) and the inlet dryness degree $X_{ei}$ of the evaporator. The average temperature difference $\Delta T_{eg}$ between the gas-phase refrigerant and the indoor air is expressed as a logarithmic mean temperature difference by the following equation.

[Numerical Expression 30]

$$\Delta T_{eg} = \frac{(T_{eai} - T_{esg}) - (T_{eai} - T_{eg})}{\ln\frac{(T_{eai} - T_{esg})}{(T_{eai} - T_{eg})}} \tag{30}$$

The evaporator outlet temperature $T_{eg}$ is obtained as the suction temperature $T_s$.

The average refrigerant densities and volumetric proportions in the respective phases can be calculated in the above manner, so the evaporator average refrigerant density $\rho_e$ can be calculated.

At the inlet and outlet of the accumulator 10, the refrigerant is in the gas-phase state because the degree of superheating of the compressor 1 on the suction side is larger than 0 degree. The accumulator refrigerant amount $M_{r,ACC}$ [kg] is expressed by the following expression.

[Numerical Expression 31]

$$M_{r,ACC} = V_{ACC} \times \rho_{ACC} \tag{31}$$

Note that $V_{ACC}$[$m_3$] represents the accumulator internal volume and is a known value because it is determined by the device specification. $\rho_{ACC}$ [kg/$m^3$] is an accumulator average refrigerant density and is obtained by calculating the accumulator inlet temperature (corresponding to the suction temperature $T_s$) and inlet pressure (corresponding to the suction pressure $P_s$).

The refrigerant amount $M_{r,OIL}$ [kg] dissolving in the refrigerating machine oil is expressed by the following expression.

[Numerical Expression 32]

$$M_{r,OIL} = V_{OIL} \times \rho_{OIL} \times \frac{\phi_{OIL}}{1 - \phi_{OIL}} \tag{32}$$

Note that $V_{OIL}$ [$m^3$] represents the volume of the refrigerating machine oil existing in the refrigerating circuit, and is known because it is a device specification. $\rho_{OIL}$ [kg/$m^3$] and $\phi_{OIL}$ [-] represent the density of the refrigerating machine oil, and the solubility of the refrigerant to the oil, respectively. Assuming that most of the refrigerating machine oil exists in the compressor 1 and accumulator 10, the refrigerating machine oil density $\rho_{OIL}$ can be treated as a constant value, and the solubility ϕ [-] of the refrigerant to the oil can be obtained by calculating the suction temperature $T_s$ and the suction pressure $P_s$ as indicated by the following expression.

[Numerical Expression 33]

$$\phi_{OIL} = f(T_s, P_s) \tag{33}$$

The procedure of calculating the refrigerant amount in each element has been described so far. If a liquid refrigerant exists in an element, e.g., a pipe that connects the constituent elements, which is not considered in the calculation, it influences the precision of the calculative refrigerant amount. When charging the refrigerant in the refrigerating circuit, if the calculation of the appropriate refrigerant amount is wrong or an error occurs in the charging operation, it leads to a difference between the appropriate refrigerant amount and the initially enclosed refrigerant amount which is the amount of refrigerant actually charged on the site. Hence, the liquid-phase volume and the initially enclosed refrigerant amount are corrected by adding an additional refrigerant amount $M_{r,ADD}$ [kg] indicated by the following expression to the calculation of the calculative refrigerant amount $M_r$ using the expression (1).

[Numerical Expression 34]

$$M_{r,ADD}=\beta\times\rho_1 \tag{34}$$

Note that $\beta$[m$^3$] represents the correction coefficient for the liquid-phase volume and initially enclosed refrigerant amount, and is obtained based on data measured using the actual refrigerating cycle apparatus. $\rho_1$ [kg/m$^3$] represents the liquid-phase density, which is a condenser outlet density $\rho_{sco}$ in this embodiment. The condenser outlet density $\rho_{sco}$ is obtained by calculating the condenser output pressure (corresponding to the discharge pressure $P_d$) and the temperature $T_{sco}$.

The correction coefficient $\beta$ for the liquid-phase volume and initially enclosed refrigerant amount changes depending on the device specification, but needs to be determined each time the refrigerant is charged in the device, because the difference between the initially enclosed refrigerant amount and the appropriate refrigerant amount should also be corrected.

When the liquid connection pipe 5 or the gas connection pipe 9 has a large internal volume, the correction coefficient $\beta$ for the liquid-phase volume and initially enclosed refrigerant amount may be obtained based on the extension pipe specification (the specification of the liquid connection pipe 5 or gas connection pipe 9). In this case, a correction coefficient r for the liquid-phase volume and initially enclosed refrigerant amount is expressed by the following expression.

[Numerical Expression 35]

$$\beta' = \frac{(M_r' - M_r)\cdot(V_{PL} + V_{PG})}{\rho'_{PL}V_{PL} + \rho'_{PG}V_{PG}} \tag{35}$$

Note that $V_{PL}$ [m$^3$] and $V_{PG}$ [m$^3$] represent a liquid connection pipe internal volume and a gas connection pipe internal volume, respectively, which are values determined by the device specification. Also, $M_r'$ [kg] represents the initially enclosed refrigerant amount, and $\rho'_{PL}$ [kg/m$^3$] and $\rho'_{PG}$ [kg/m$^3$] are average refrigerant densities in the liquid connection pipe and gas connection pipe, respectively, when the refrigerant amount is appropriate, which are obtained based on the measurement data. Correction of the liquid-phase volume and initially enclosed refrigerant amount in the case of using $\beta'$ is expressed by the following expression.

[Numerical Expression 36]

$$M_{r,ADD} = \beta' \frac{\rho_{PL}V_{PL} + \rho_{PG}V_{PG}}{(V_{PL} + V_{PG})} \tag{36}$$

By adding $M_{r,ADD}$, calculated in accordance with equation (36) in place of expression (34), to expression (1), the liquid-phase volume and initially enclosed refrigerant amount can be corrected.

In the above manner, the condenser refrigerant amount $M_{r,c}$, the liquid connection pipe refrigerant amount $M_{r,PL}$, the evaporator refrigerant amount $M_{r,e}$, the gas connection pipe refrigerant amount $M_{r,PG}$, the accumulator refrigerant amount $M_{r,ACC}$, the refrigerant amount $M_{r,OIL}$ dissolving in the oil, and the additional refrigerant amount $M_{r,ADD}$ can be calculated, so the calculative refrigerant amount $M_r$ can be obtained.

<Influence of Liquid Refrigerant Amount Correction on Calculative Refrigerant Amount>

Figure 4:
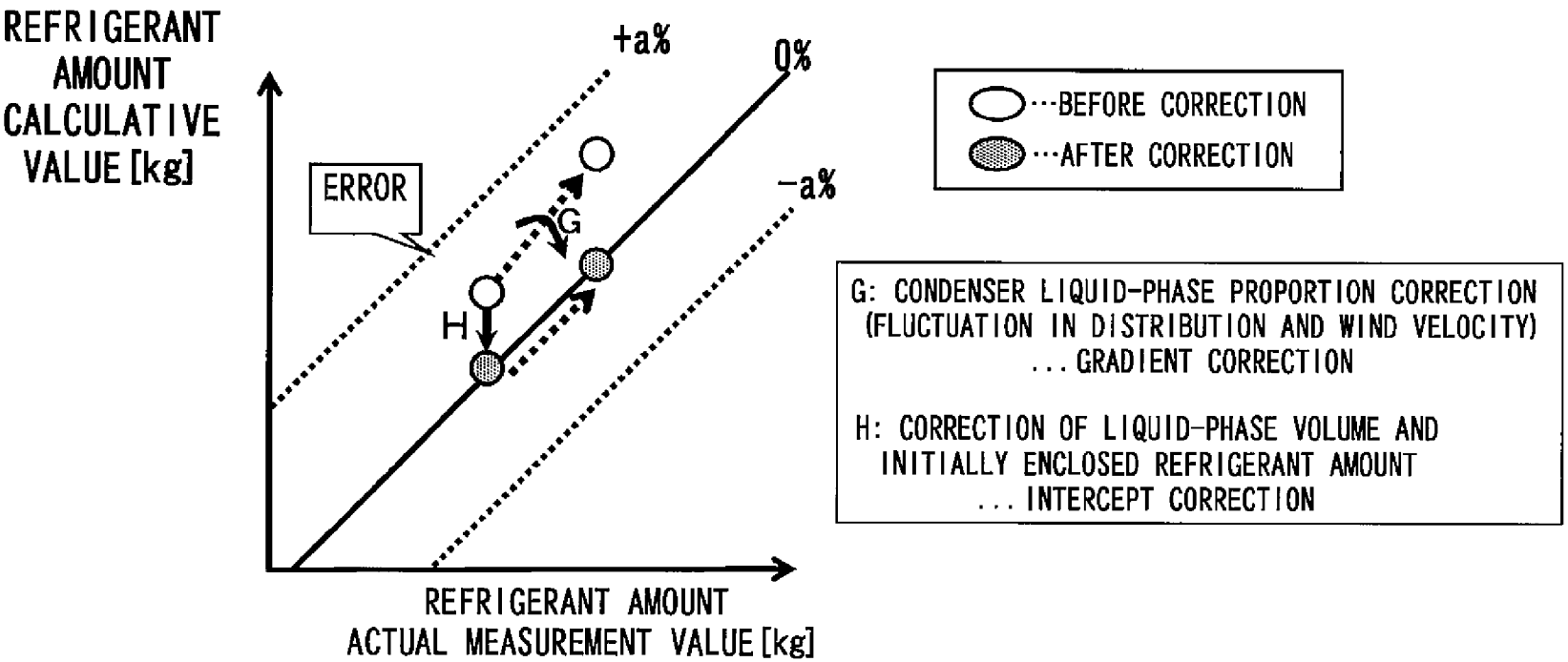
FIG. 4 is a schematic graph of an influence exercised on the calculation of the refrigerant amount by correction of the first embodiment of the present invention.

When obtaining the calculative refrigerant amount $M_r$ according to this embodiment, two corrections, i.e., condenser liquid-phase proportion correction, and correction of the liquid-phase volume and initially enclosed refrigerant amount, are carried out. FIG. 4 shows a concept graph of the influence which the correction exercises on the calculative refrigerant amount. The larger the refrigerant amount, the higher the degree of superheating at the condenser outlet, and the larger the liquid refrigerant amount in the condenser. It can be understood that correction of the condenser liquid-phase proportion enlarges the change in liquid refrigerant amount in the condenser with respect to the refrigerant amount. It can also be understood that practicing correction of the liquid-phase volume and initially enclosed refrigerant amount is adding a liquid-phase refrigerant which was not considered before the correction.

<Procedure of Performing Correction of Liquid Refrigerant Amount>

The condenser liquid-phase proportion correction coefficient $\alpha$ and the correction coefficient $\beta$ for the liquid-phase volume and initially enclosed refrigerant amount change depending on the device specification and the operation mode. Hence, a test is required for each device specification and each operation mode.

Figure 5:
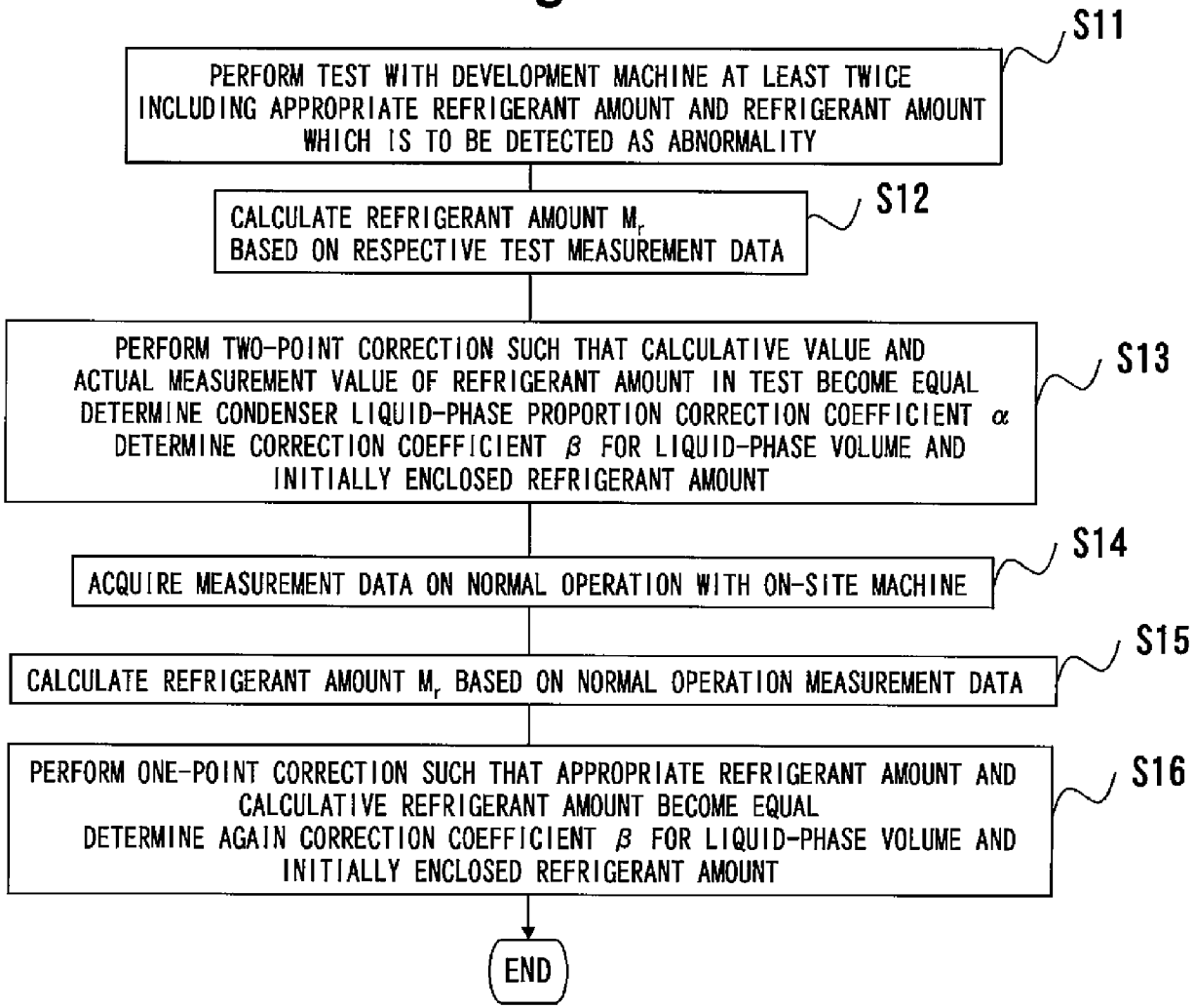
FIG. 5 is a flowchart showing a correction coefficient determination method for an air conditioning apparatus according to the first embodiment of the present invention.

More specifically, a method of determining the condenser liquid-phase proportion correction coefficient $\alpha$ and the correction coefficient $\beta$ for the liquid-phase volume and initially enclosed refrigerant amount will be described with reference to the flowchart shown in FIG. 5.

First, in step S11, test is performed with a development machine at least twice including the appropriate refrigerant amount and the refrigerant amount which is to be detected as excess or shortage abnormality.

In step S12, the refrigerant amount $M_r$ is calculated based on the respective test data.

In step S13, the condenser liquid-phase proportion correction coefficient $\alpha$ and the correction coefficient $\beta$ for the liquid-phase volume and initially enclosed refrigerant amount are obtained by performing two-point correction in accordance with the method of least squares, such that the calculative value and the actually measured value become equal.

In step S14, measurement data on the operation state amount is acquired with an on-site machine while it operates normally.

In step S15, the calculative refrigerant amount is calculated based on the measurement data obtained during the normal operation.

In step S16, the correction coefficient $\beta$ for the liquid-phase volume and initially enclosed refrigerant amount is obtained by performing one-point correction in accordance with the method of least squares or the like, such that the appropriate refrigerant amount and the calculative refrigerant amount become equal.

The obtained correction coefficients are stored in the storage part 104, and applied to the refrigerant amount calculation. The condenser liquid-phase proportion correction coefficient α and the correction coefficient β for the liquid-phase volume and initially enclosed refrigerant amount are obtained by performing the operation shown in FIG. 5 for each specification and for each of the cooling mode and heating mode.

After refrigerant leakage is detected, the abnormal portion is repaired, and the refrigerant is charged again. Processing of the condenser liquid-phase proportion correction coefficient α and the correction coefficient β for the liquid-phase volume and initially enclosed refrigerant amount, after the recharge, will be described.

The condenser liquid-phase proportion correction coefficient α is a coefficient that is influenced by the device specification, particularly the condenser specification. As far as the specification before abnormal portion repair and the specification after abnormal portion repair do not differ, the same value as the value determined before the recharge can be applied.

The correction coefficient β for the liquid-phase volume and initially enclosed refrigerant amount is used to correct the difference between the initially enclosed refrigerant amount and the appropriate refrigerant amount as well. Therefore, the value of the correction coefficient β must be determined each time the refrigerant is charged.

Figure 6:
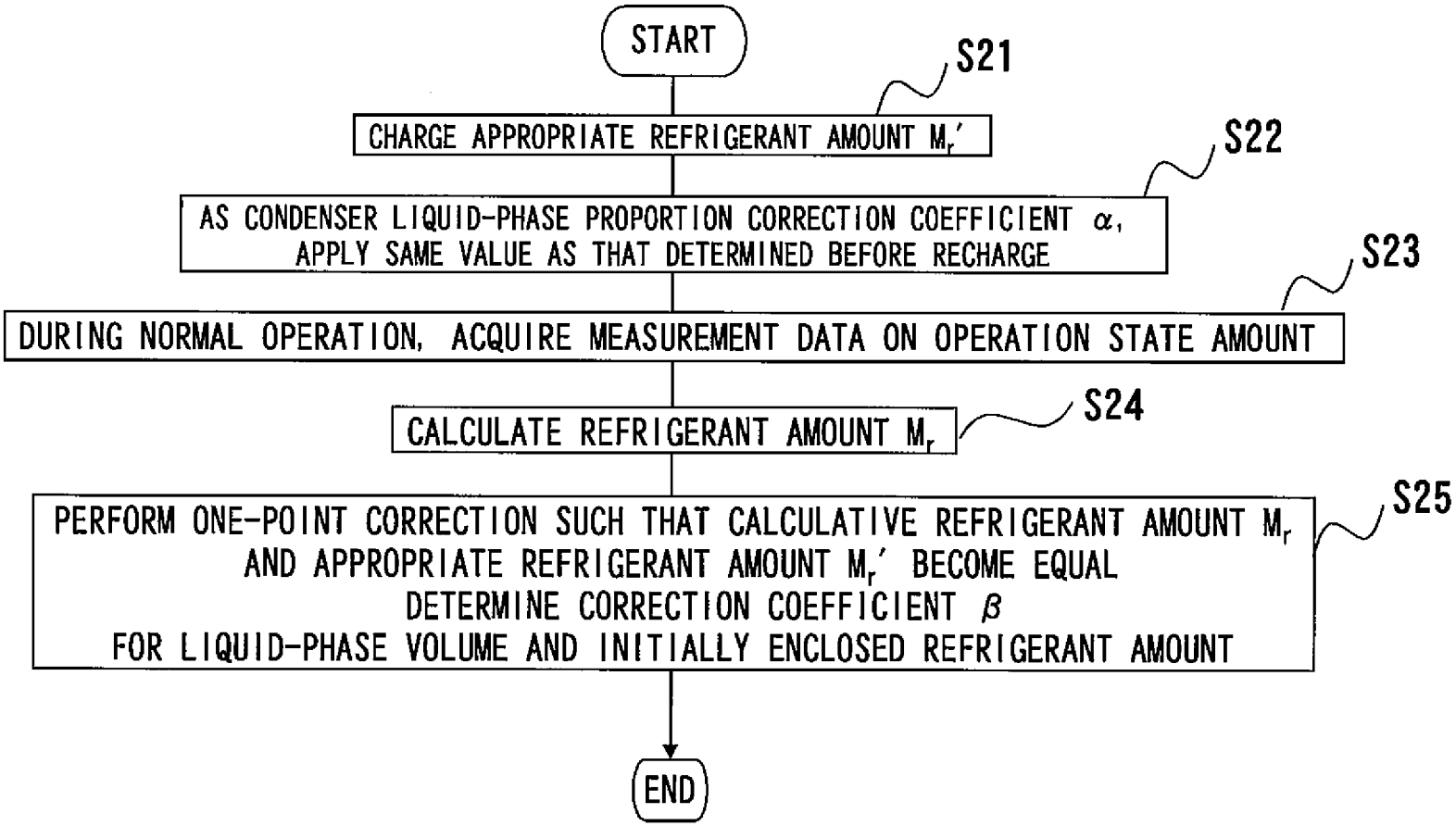
FIG. 6 is a flowchart showing a correction coefficient determination method after the refrigerant is recharged in the first embodiment of the present invention.

How to determine the correction coefficient after the refrigerant is enclosed again will be described with reference to the operation flowchart shown in FIG. 6.

In step S21, an appropriate refrigerant amount $M_r'$ is recharged. After that, in step S22, as the condenser liquid-phase proportion correction coefficient α, the same value as that determined before the recharge is applied.

In step S23, measurement data on the operation state amount is acquired during normal operation.

In step S24, the refrigerant amount is calculated.

In step S25, in correction of the liquid-phase volume and initially enclosed refrigerant amount, one-point correction is performed such that the calculative refrigerant amount and the appropriate refrigerant amount become equal, thus obtaining the correction coefficient β for the liquid-phase volume and initially enclosed refrigerant amount.

The obtained correction coefficients are stored in the storage part 104, and applied in the refrigerant amount calculation.

The correction method is not limited to those described above if correction relating to the liquid-phase part is carried out. The larger the number of correcting portions, the higher the calculation precision of the refrigerant amount.

In the actual correction, measurement data corresponding at least in number to the correction coefficients is required. As the correction coefficients are largely influenced by the specification of the real machine, the measurement data is required for each device.

<Refrigerant Amount Excess/Shortage Determination>

How to determine the excess/shortage of the refrigerant amount based on the calculative refrigerant amount will now be described. The excess/shortage of the refrigerant amount is determined by using the refrigerant overcharge/undercharge ratio r[%]. Information on various types of sensors is acquired by the measurement part 101 of FIG. 1. After that, the calculative refrigerant amount $M_r$ is calculated by the calculation part 102 in accordance with the above method using the condenser liquid-phase proportion correction coefficient α and the correction coefficient β for the liquid-phase volume and initially enclosed refrigerant amount, which are acquired in the storage part 104 in advance. Using the appropriate refrigerant amount $M_r'$ acquired in the storage part 104 in advance, the refrigerant overcharge/undercharge ratio r indicated in the following expression is calculated.

[Numerical Expression 37]

$$r = \frac{M_r' - M_r}{M_r'} \times 100 \tag{37}$$

The comparison part 105 compares the refrigerant overcharge/undercharge ratio r, and the lower-limit threshold value $X_l$[%] or upper-limit threshold value $X_u$[%] which is acquired in the storage part 104 in advance. The determination part 106 determines the refrigerant amount excess or shortage. Based on the determination result, the notification part 107 performs a process of notifying the refrigerant amount excess/shortage using an LED or the like.

Figure 7:
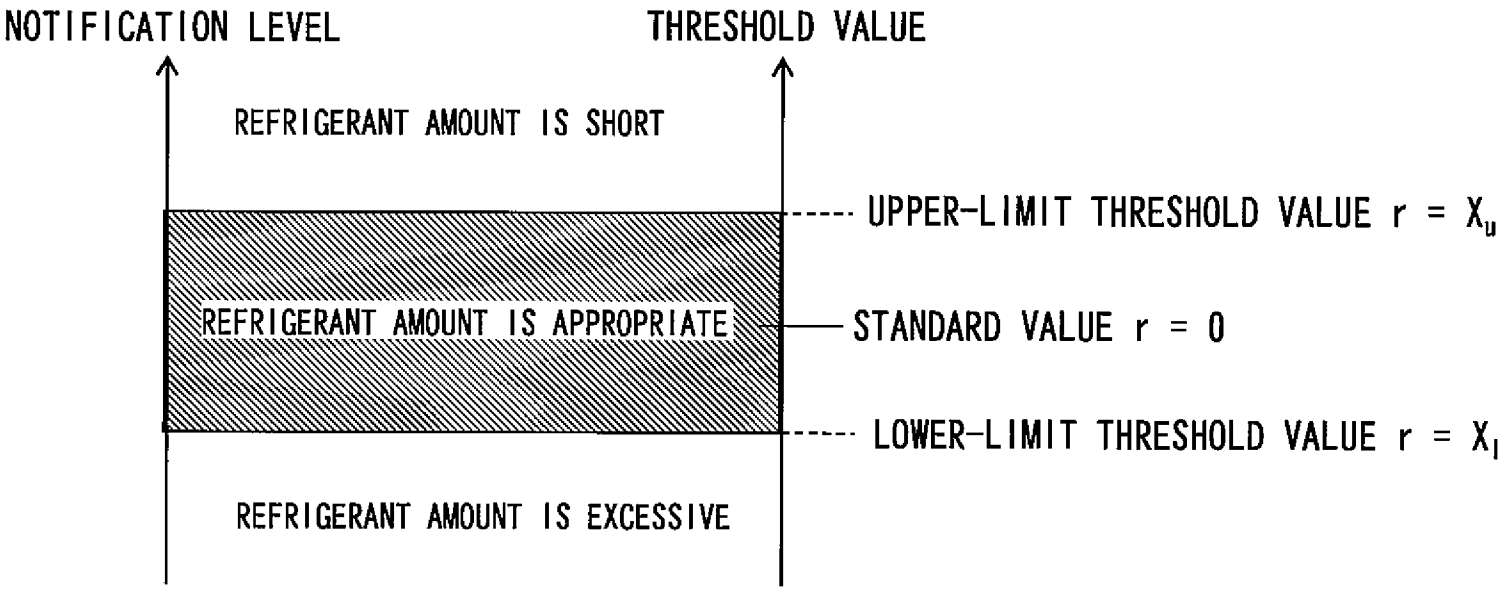
FIG. 7 is a graph showing the relationship between the excess/shortage of the refrigerant amount and the notification level of the first embodiment of the present invention.

The operation of the determination part 106 will be described in detail with reference to FIG. 7. For example, when the lower-limit threshold value $X_l$=−b% and upper-limit threshold value $X_u$=+b%, if the refrigerant overcharge/undercharge ratio r is equal to −b or less, it is determined that the refrigerant amount is excessive; if equal to +b or more, it is determined that the refrigerant amount is short.

By outputting the refrigerant overcharge/undercharge ratio r to a display means such as a display, the operator can readily check the state of the refrigerant amount in the refrigerating circuit.

<Execution of Refrigerant Leakage Amount Determination and Checking Procedure>

Figure 8:
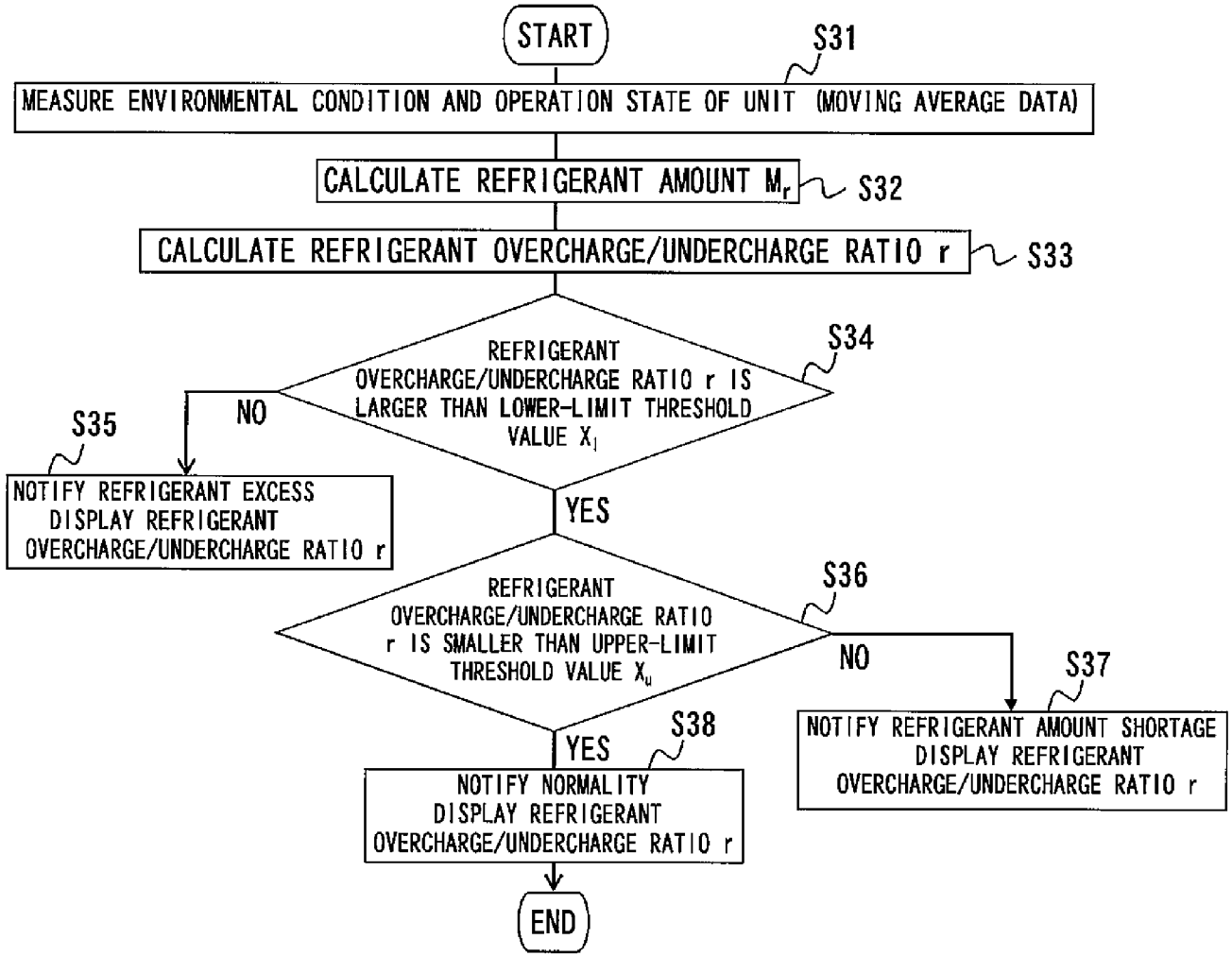
FIG. 8 is an operation flowchart for refrigerant leakage amount determination of the first embodiment of the present invention.

Execution of refrigerant leakage amount determination and a checking procedure will be described with reference to the flowchart shown in FIG. 8.

First, when a predetermined period of time (e.g., every other day) has elapsed, in step S31, the operation state amount such as the temperature or pressure is acquired automatically by using a timer or the like, or manually by using a DIP switch or the like, to measure the environmental condition of the indoor/outdoor air temperature and the operation states of the refrigerating cycles of the heat source unit 301 and utilization unit 302.

When the operation state data acquisition in step S31 is carried out while the change amounts of the blow amounts of the outdoor blower 4 of the heat source unit 301 and of the indoor blower 8 of the utilization unit 302, the operation frequency of the compressor 1 of the heat source unit 301, and the opening area of the pressure reducing device 6 are minimum, the refrigerating cycle is stabilized, and transient characteristics decrease, so that refrigerant amount excess/shortage determination can be performed at high precision.

When, e.g., the moving average data is employed, the transient characteristics of the data can be decreased, so that the refrigerant amount excess/shortage determination can be performed at high precision.

Then, in step S32, the calculative refrigerant amount $M_r$ is calculated based on the operation state amount. In step S33, the refrigerant overcharge/undercharge ratio r is calculated.

In step S34, the refrigerant overcharge/undercharge ratio r and the lower-limit threshold value $X_l$ are compared. If the refrigerant overcharge/undercharge ratio r is smaller than the lower-limit threshold value $X_l$, it is determined that the refrigerant amount is excessive. In step S35, a refrigerant excess abnormality is notified, and the refrigerant overcharge/undercharge ratio r is displayed.

If the refrigerant overcharge/undercharge ratio r is larger than the lower-limit threshold value $X_l$, the refrigerant overcharge/undercharge ratio r and the upper-limit threshold value $X_u$ are compared in step S36. If the refrigerant overcharge/undercharge ratio r is larger than the upper-limit threshold value $X_u$, it is determined that the refrigerant amount is short. In step S37, a refrigerant amount shortage abnormality is notified, and the refrigerant overcharge/undercharge ratio r is displayed.

If the refrigerant overcharge/undercharge ratio r is smaller than the upper-limit threshold value $X_u$, it is determined that the refrigerant amount is normal. In step S38, normality is notified, and the refrigerant overcharge/undercharge ratio r is displayed. Then, the detection ending process is carried out.

By displaying the refrigerant overcharge/undercharge ratio r in step S35, step S37, and step S38, the operator can grasp the state of the apparatus in more detail, so that the maintenance easiness can be improved.

If the refrigerant amount excess/shortage determination is carried out at shorter intervals, the refrigerant leakage can be discovered at an early stage, so that a failure of the device can be prevented.

Figure 9:
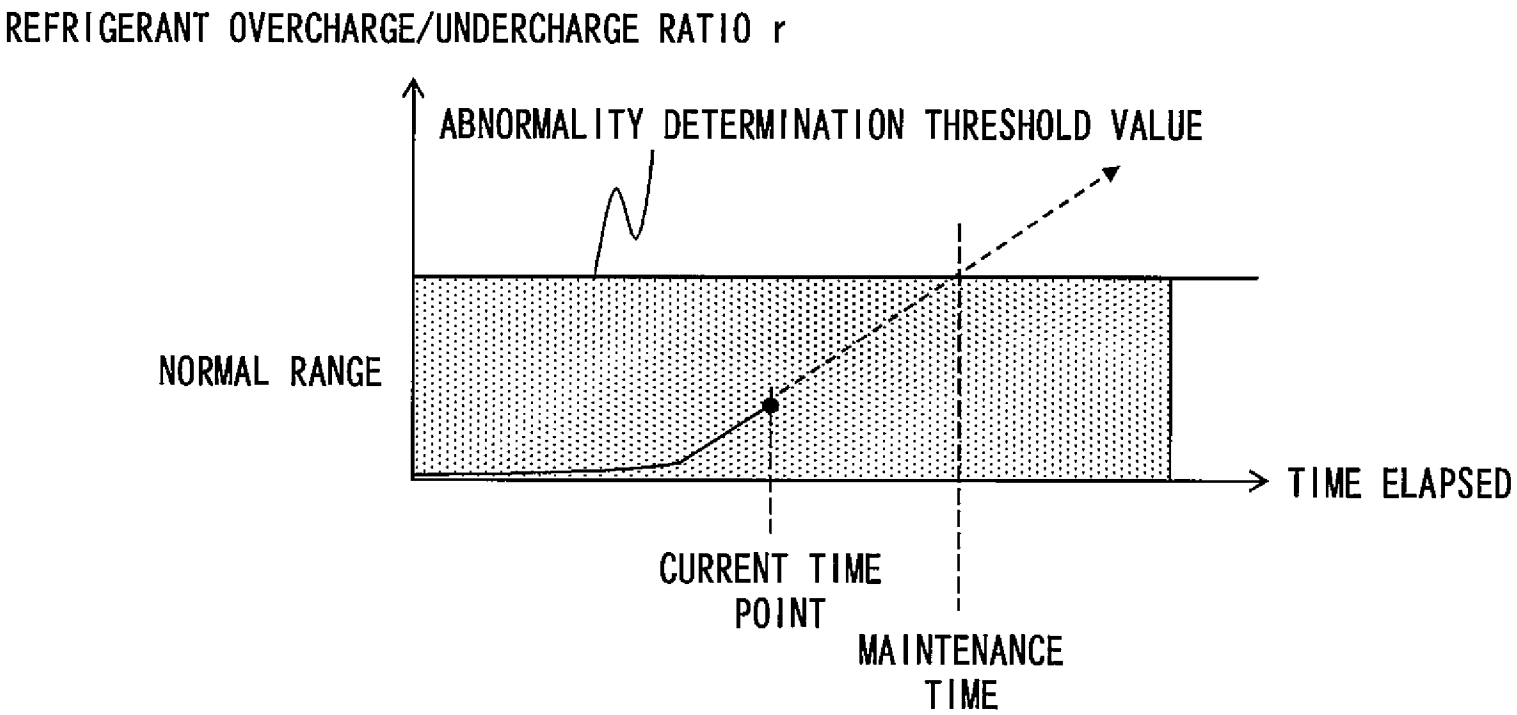
FIG. 9 is a schematic graph showing a trend change in refrigerant overcharge/undercharge ratio of the first embodiment of the present invention.

As shown in FIG. 9, when the refrigerant overcharge/undercharge ratio r and the determination time and date are held in the storage part 104, the refrigerant leakage can be predicted based on the trend change in refrigerant overcharge/undercharge ratio r. When a refrigerant amount shortage abnormality is notified, the information on refrigerant overcharge/undercharge ratio r and determination time and date are helpful in specifying the cause of the refrigerant leakage.

In other words, the storage part 104 sequentially stores the degree of divergence between the calculative refrigerant amount $M_r$ and the appropriate refrigerant amount $M_r'$, and predicts refrigerant leakage from the refrigerating circuit based on the trend change in degree of divergence between the calculative refrigerant amount $M_r$ and appropriate refrigerant amount $M_r'$.

Also, the air conditioning apparatus may be connected to a local controller serving as a management device that manages the respective constituent devices of the air conditioning apparatus and acquires operation data by communicating with the outside such as a telephone circuit, a LAN circuit, or a wireless circuit, the local controller may be connected via the network to the remote server of an information management center that receives the operation data of the air conditioning apparatus, and the remote server may be connected to a storage device such as a disk device which stores the operation state amount, so that a refrigerant amount determination system is constituted.

For example, the following configuration may be possible. The local controller serves as the measurement part 101 that acquires the operation state amount of the air conditioning apparatus, and as the calculation part 102 that calculates the operation state amount. The storage device serves as the storage part 104. The remote server serves as the comparison part 105, determination part 106, and notification part 107. In this case, the air conditioning apparatus need not have the function of calculating and comparing the calculative refrigerant amount $M_r$ and refrigerant overcharge/undercharge ratio r based on the current operation state amount. By constructing a remote monitoring system in this manner, the operator in charge of the maintenance need not go to the installation site and check the excess/shortage of the refrigerant amount at the time of periodical maintenance. As a result, the reliability and operability of the devices improve.

The storage part 104 is a memory in the substrate in the air conditioning apparatus, or a memory accompanying the compressor 1, or a memory in a device installed outside the air conditioning apparatus and connected to the air conditioning apparatus via a wire or in a wireless manner, and is formed of a rewritable memory.

The embodiment of the present invention has been described so far with reference to the drawings. Note that the actual configuration is not limited to these embodiments, but can be changed within a range not departing from the spirit of the invention. For example, while the above embodiment describes an example in which the present invention is applied to an air conditioning apparatus that can be switched between the cooling/heating modes, the present invention is not limited to this example, but can be applied to an air conditioning apparatus dedicated to cooling or heating only.

The above description refers to an apparatus in which the refrigerant takes a two-phase state in the condensing process. Even when the refrigerant in the refrigerating cycle is a high-pressure refrigerant such as $CO_2$ that exhibits a state change (accompanying a change in physical properties in a supercritical range) under a pressure equal to or higher than the supercritical point, if the refrigerant can be treated in a gas cooler as a liquid-phase refrigerant at a temperature equal to a pseudo-critical temperature or less against a high-pressure-side pressure $P_d$, correction of the liquid refrigerant amount can be applied.

According to the present invention, the degree of superheating of the compressor 1 on the suction side is set to be larger than 0, so that the gas refrigerant fills the accumulator 10. Even when a liquid refrigerant is mixed in the accumulator 10, if the liquid level is detected by adding a sensor that detects the liquid level of the accumulator 10, the volumetric ratio of the liquid refrigerant to the gas refrigerant becomes known. As a result, the refrigerant amount existing in the accumulator 10 can be calculated.

In this embodiment, the smaller the refrigerant amount, the lower the degree of supercooling at the condenser outlet. When, however, the refrigerant amount decreases, the refrigerant becomes of the gas-liquid two-phase state at the condenser outlet. Then, the state of the condenser outlet cannot be determined based on only the measurement of the temperature and pressure, making it difficult to calculate the calculative refrigerant amount. In this case, a refrigerant amount shortage abnormality is notified when the degree of supercooling of the condenser reaches 0.

Embodiment 2

Device Configuration

The second embodiment of the present invention will now be described with reference to FIG. 10. The same structural portions as those of the first embodiment are denoted by the same numerals, and a detailed description thereof will be omitted.

Figure 10:
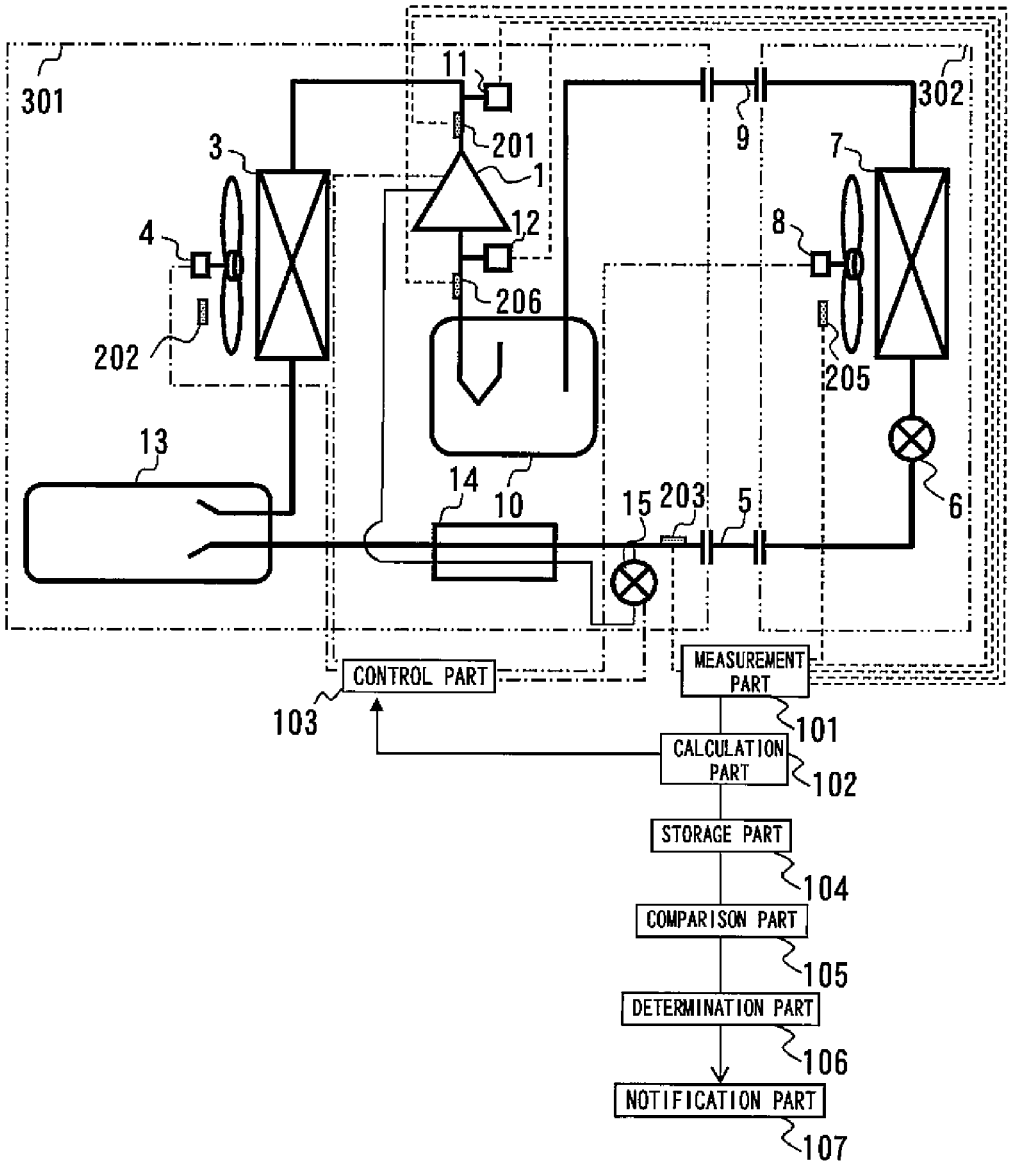
FIG. 10 is a refrigerating circuit diagram of a refrigerator that employs a refrigerant amount determination system according to the second embodiment of the present invention.

FIG. 10 shows the refrigerating circuit of a refrigerating machine (refrigerating cycle apparatus) according to the second embodiment of the present invention. The refrigerating circuit of the second embodiment is constituted by removing the four-way valve 2 from the refrigerating circuit of the first embodiment, having a receiver 13 that reserves an excessive refrigerant and a supercooling coil 14 at the next stage of the outdoor heat exchanger 3, and providing an injection flow channel (distribution circuit) for the compressor 1 and an inflow channel for the indoor heat exchanger 7 at the next stage of the receiver 13 and supercooling coil 14. The injection flow channel is provided with a pressure reducing device 15 (second pressure reducing device).

The supercooling coil 14 and the injection flow channel which has the pressure reducing device 15 constitute one bypass unit. Alternatively, the refrigerating circuit may have a plurality of bypass units.

The refrigerant flowing to the injection flow channel for the compressor 1 is pressure-reduced by the pressure reducing device 15 (second pressure reducing device), is superheated in the supercooling coil 14 by the refrigerant that has passed through the receiver 13, and flows into the compressor 1.

The refrigerant passing through the receiver 13 is cooled in the supercooling coil 14 by the refrigerant that has passed through the pressure reducing device 15. After that, the refrigerant is distributed between the liquid connection pipe 5 and the pressure reducing device 15. The refrigerant flowing into the liquid connection pipe 5 then flows into the pressure reducing device 6.

According to the device specification, the outdoor heat exchanger 3 serves as the condenser of the refrigerant compressed by the compressor 1, and the indoor heat exchanger 7 serves as the evaporator of the refrigerant condensed by the outdoor heat exchanger 3. As the output capacity of the utilization unit 302 is determined at the time of device installation, an excessive refrigerant is reserved in advance in the receiver 13 of the heat source unit 301.

<Change in Refrigerating Cycle Operation State with Respect to Refrigerant Amount>

Figure 11:
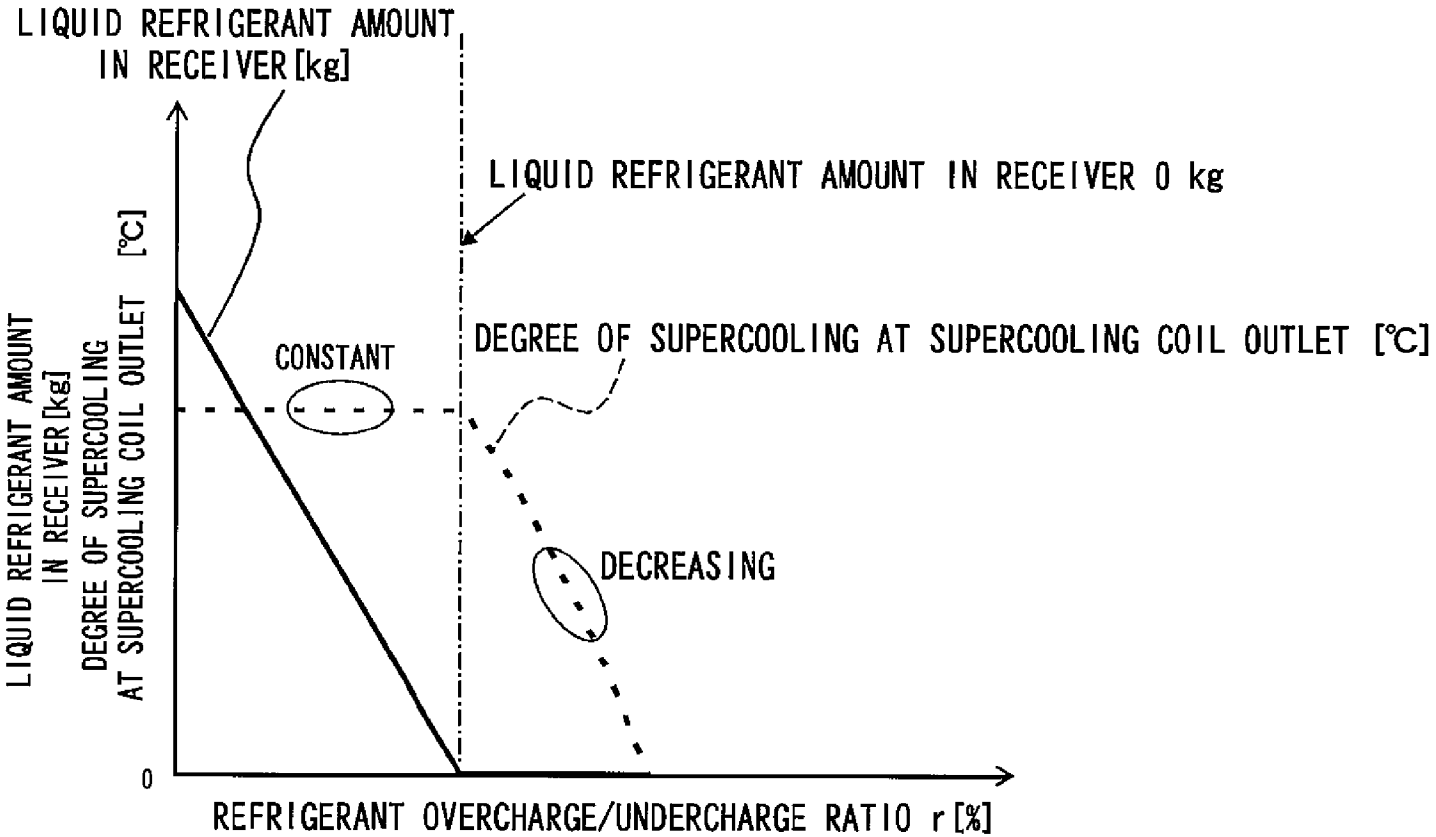
FIG. 11 is a graph showing a change in liquid refrigerant amount in a receiver 13 and a change in degree of supercooling of a supercooling coil as a function of a refrigerant overcharge/undercharge ratio r in the second embodiment of the present invention.

FIG. 11 shows a change in liquid refrigerant amount of the receiver 13 with respect to a refrigerant overcharge/undercharge ratio r and a change in degree of supercooling of the supercooling coil 14 of this embodiment. According to this embodiment, when a liquid refrigerant exists in the receiver 13, as shown in FIG. 11, although the liquid refrigerant amount in the receiver 13 decreases with respect to the refrigerant overcharge/undercharge ratio r, the degree of supercooling of the supercooling coil 14 does not change, and accordingly the operation state does not change.

Therefore, in this case, a change in refrigerant amount cannot be calculated based on the operation state. When, however, the liquid refrigerant amount of the receiver 13 is 0 kg, the degree of supercooling of the supercooling coil 14 with respect to the refrigerant overcharge/undercharge ratio r decreases, and the operation state changes. Therefore, a change in refrigerant amount can be calculated based on the operation state.

As in this embodiment, in a refrigerating circuit provided with the receiver 13, when the shortage of the refrigerant amount is to be determined, if the upper-limit threshold value $X_u$ is set to such a large degree that the refrigerant existing in the receiver 13 entirely becomes saturated vapor, the calculative refrigerant amount $M_r$ and the refrigerant overcharge/undercharge ratio r can be calculated based on the operation state amount, and the shortage of the refrigerant amount can be determined.

When a liquid refrigerant exists in the receiver 13, for example, if a sensor that detects the liquid level is added to the receiver 13 and the liquid level detection is conducted, the volumetric ratio of the liquid refrigerant to the gas refrigerant becomes known, and the refrigerant amount in the receiver 13 can be calculated. As a result, refrigerant leakage can be detected at an early stage before the liquid refrigerant in the receiver 13 runs out.

In a refrigerating circuit provided with the receiver 13 as in this embodiment, however, in a state where a sensor to detect the liquid level is not added to the receiver 13 and the liquid refrigerant exists in the receiver 13, when the excess/shortage of the refrigerant amount is to be determined, because detection in normal operation becomes difficult, a special operation need be conducted so that the liquid refrigerant in the receiver 13 is reserved in the condenser as much as possible.

<Excessive Refrigerant Purge Operation>

In the special operation, the control part 103 increases the operation frequency (operation capability) of the compressor 1 to increase the condensing pressure, so that the pressure at the outlet of the compressor 1 becomes a predetermined value. Therefore, the gas refrigerant amount in the condenser decreases, and the liquid refrigerant in the receiver 13 can be reserved in the condenser.

In addition, by controlling the opening degree (opening area) of the pressure reducing device 6, the gas refrigerant decreases and the two-phase refrigerant increases in the evaporator. As a result, the liquid refrigerant in the receiver 13 can be reserved in the evaporator.

In addition, by increasing the opening degree (opening area) of the pressure reducing device 15 of the injection flow channel (distribution circuit), the degree of superheating of the compressor 1 on the discharge side can be decreased. Then, the gas refrigerant amount in the condenser further decreases, so that the liquid refrigerant in the receiver 13 can be reserved in the condenser. By controlling in this manner, the degree of supercooling of the supercooling coil 14 with respect to the refrigerant amount changes, and accordingly that the refrigerant amount can be calculated based on the operation state amount of the refrigerating cycle.

Hence, by practicing the special operation, even if the refrigerating circuit is provided with the receiver 13, the refrigerant amount excess/shortage can be determined at high precision under any installation conditions and environmental conditions without using a specific detection device that detects the liquid level. Also, by calculating the refrigerant amount periodically, refrigerant leakage can be discovered at an early stage, and a failure of the device can be prevented.

<Control for Constant Supercooling Coil Outlet Temperature>

The liquid refrigerant exists in the liquid connection pipe 5. By controlling the pressure reducing device 15 to keep the outlet temperature of the supercooling coil 14 constant, the temperature of the liquid connection pipe 5 becomes constant. Then, the refrigerant amount in the liquid connection pipe 5 becomes constant regardless of the refrigerant amount in the refrigerating circuit. As a result, it can be expected that precision of the refrigerant amount excess/shortage determination be improved.

Embodiment 3

Device Configuration

The third embodiment of the present invention will be described with reference to the drawings. The same structural portions as those of the first embodiment are denoted by the same numerals, and a detailed description thereof will be omitted.

Figure 12:
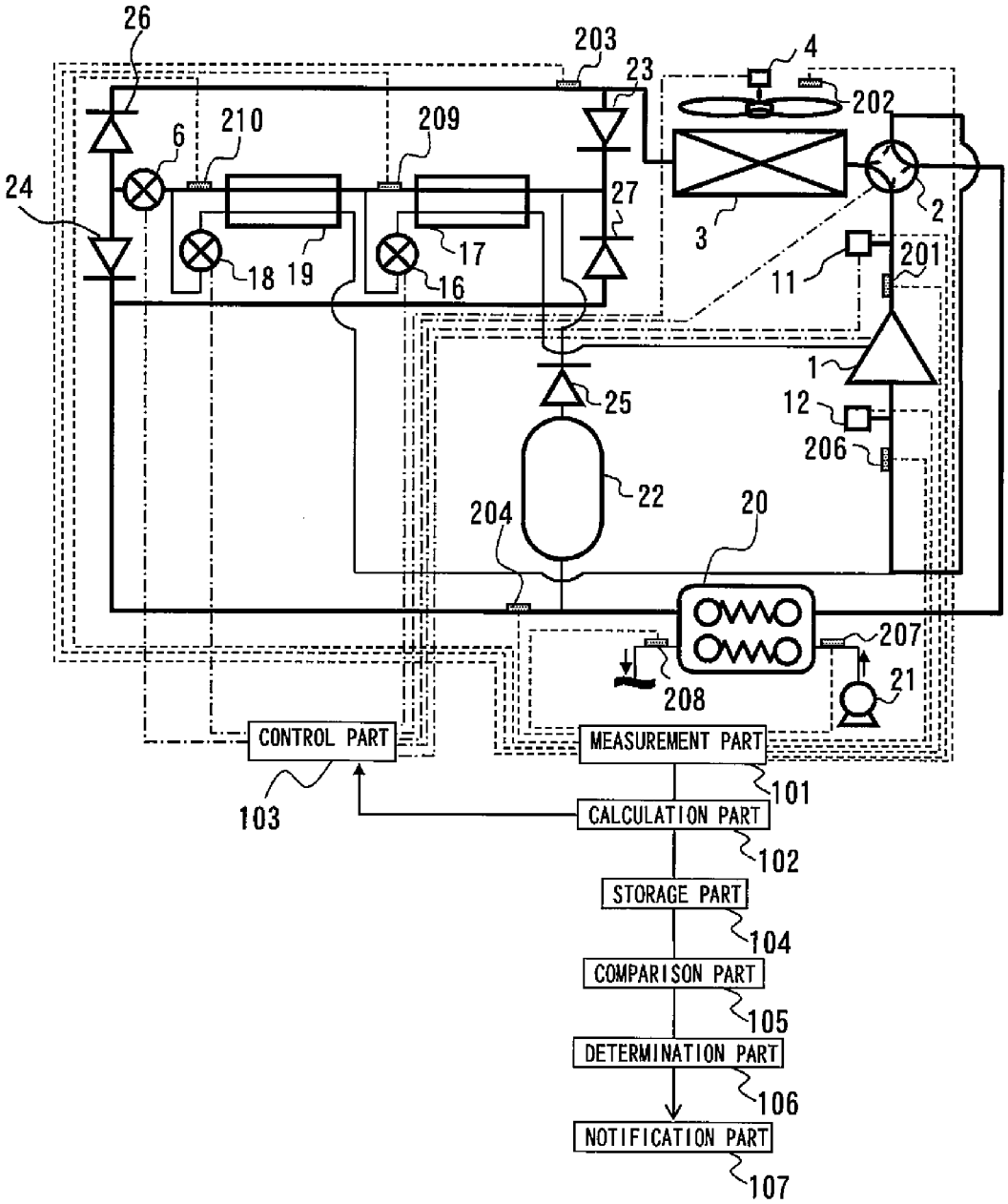
FIG. 12 is a refrigerating circuit diagram of an air-cooling heat pump chiller apparatus that employs a refrigerant amount determination system according to the third embodiment of the present invention.

FIG. 12 is a refrigerating circuit diagram of an air-cooling heat pump chiller apparatus that employs a refrigerant amount determination system according to the third embodiment of the present invention. The air-cooling heat pump chiller apparatus (refrigerating cycle apparatus) is an apparatus used to cool or heat water by carrying out vapor compression type refrigerating cycle operation.

This refrigerating circuit is provided with at least a compressor 1 which compresses a refrigerant, a four-way valve 2 which switches the refrigerant flowing direction, an outdoor heat exchanger 3 serving as a heat source side heat exchanger, a supercooling coil 17, a supercooling coil 19, pressure reducing devices 6, 16, and 18, a water supply pump 21, a water heat exchanger 20 serving as a utilization side heat exchanger, a refrigerant tank 22, and check valves 23, 24, 25, 26, and 27. An outdoor blower 4 which blows air to the outdoor heat exchanger 3 is provided in the vicinity of the outdoor heat exchanger 3.

As sensors that detect the temperatures of the respective portions of the refrigerating circuit, the refrigerating circuit is also provided with a discharge temperature sensor 201, an outdoor temperature sensor 202, a liquid-side temperature sensor 203, a liquid-side temperature sensor 204, and a suction temperature sensor 206 which are the same as those of FIG. 1 or 10. As other sensors, the refrigerating circuit is also provided with an inflow water temperature sensor 207, an outflow water temperature sensor 208, a liquid-side temperature sensor 209, and a liquid-side temperature sensor 210. The inflow water temperature sensor 207 detects the inflow water temperature of the water heat exchanger 20. The outflow water temperature sensor 208 detects the outflow water temperature of the water heat exchanger 20. The liquid-side temperature sensor 209 detects the outlet-side liquid temperature of the supercooling coil 17. The liquid-side temperature sensor 210 detects the outlet-side liquid temperature of the supercooling coil 19.

In this embodiment, the outdoor heat exchanger 3 is a heat exchanger that serves as a refrigerant condenser in the cooling mode and as a refrigerant evaporator in the heating mode.

The water heat exchanger 20 is a heat exchanger that serves as a refrigerant evaporator in the cooling mode to cool water, and as a refrigerant condenser in the heating mode to heat water.

<Normal Operation>

The normal operation will now be described with reference to FIG. 12. First, in the cooling mode, the four-way valve 2 is in the state indicated by the solid lines in FIG. 12. Namely, the discharge side of the compressor 1 is connected to the gas side of the outdoor heat exchanger 3, and the suction side of the compressor 1 is connected to the gas side of the water heat exchanger 20.

In this state of the refrigerating circuit, when the compressor 1, outdoor blower 4, and water supply pump 21 are started, the low-pressure gas refrigerant is taken by the compressor 1 and compressed, to become a high-pressure gas refrigerant. After that, the high-pressure gas refrigerant is supplied to the outdoor heat exchanger 3 via the four-way valve 2, and is condensed as it heat-exchanges with the outdoor air supplied by the outdoor blower 4, to become a high-pressure liquid refrigerant.

The high-pressure liquid refrigerant passes through the check valve 23 and is cooled in the supercooling coil 17 by the two-phase refrigerant that has passed through the pressure reducing device 16. After that, the refrigerant is distributed between the supercooling coil 19 and the pressure reducing device 16. The refrigerant flowing into the pressure reducing device 16 is pressure-reduced, and then heated in the supercooling coil 17 by the refrigerant that has passed through the check valve 23.

After that, the refrigerant is injected by the compressor 1. The pressure reducing device 16 controls the flow rate of the refrigerant flowing in the supercooling coil 17, to keep the degree of superheating during discharge of the compressor 1 at a predetermined value. The refrigerant flowing into the supercooling coil 19 is cooled in the supercooling coil 19 by the two-phase refrigerant that has passed through the pressure reducing device 18.

After that, the refrigerant is distributed between the pressure reducing device 18 and the pressure reducing device 6. The refrigerant flowing into the pressure reducing device 18 is pressure-reduced, and then heated in the supercooling coil 19 by the liquid-phase refrigerant that has passed through the supercooling coil 17 and flows into the supercooling coil 19. After that, on the suction side of the compressor 1, the refrigerant merges with the gas-phase refrigerant that has passed through the water heat exchanger 20.

Meanwhile, the refrigerant flowing into the pressure reducing device 6 is pressure-reduced by the pressure reducing device 6 to become a low-temperature, low-pressure gas-liquid two-phase refrigerant. This refrigerant heat-exchanges in the water heat exchanger 20 with water supplied by the water supply pump 21, and evaporates to become a low-pressure gas refrigerant. The refrigerant tank 22 is filled with saturated gas. The pressure reducing device 6 controls the flow rate of the refrigerant flowing in the water heat exchanger 20, to keep the degree of superheating during suction by the compressor 1 at a predetermined value. Therefore, the low-pressure gas refrigerant evaporated in the water heat exchanger 20 has a predetermined degree of superheating. In this manner, the refrigerant flows in the water heat exchanger 20 at a flow rate corresponding to the operation load required by the water temperature.

The low-pressure gas refrigerant flows via the four-way valve 2 and merges with the refrigerant passing through the pressure reducing device 18 and supercooling coil 19, and is taken by the compressor 1.

In the heating mode, the four-way valve 2 is in the state indicated by the broken lines in FIG. 12. Namely, the discharge side of the compressor 1 is connected to the gas side of the water heat exchanger 20, and the suction side of the compressor 1 is connected to the gas side of the outdoor heat exchanger 3.

In this state of the refrigerating circuit, when the compressor 1, outdoor blower 4, and water supply pump 21 are started, the low-pressure gas refrigerant is taken by the compressor 1 and compressed, to become a high-pressure gas refrigerant. After that, the high-pressure gas refrigerant is supplied to the water heat exchanger 20 via the four-way valve 2, and is condensed as it heat-exchanges with water supplied by the water supply pump 21, to become a high-pressure liquid refrigerant.

The high-pressure liquid refrigerant is distributed between the refrigerant tank 22 and check valve 25, and the check valve 27. The distributed refrigerants then merge. This structure is employed because the heating mode requires less refrigerant amount for operation than the cooling mode. Then, the excessive refrigerant can be reserved in the refrigerant tank 22.

Note that the refrigerant tank 22 is filled with the high-pressure liquid refrigerant. After the merge, the refrigerant is cooled in the supercooling coil 17 by the two-phase refrigerant that has passed through the pressure reducing device 16. After that, the refrigerant is distributed between the supercooling coil 19 and the pressure reducing device 16. The refrigerant flowing into the pressure reducing device 16 is pressure-reduced, and then heated in the supercooling coil 17 by the refrigerant passing through the check valve 27, and by the refrigerant passing through the refrigerant tank 22 and check valve 25.

After that, the refrigerant is injected by the compressor 1. The pressure reducing device 16 controls the flow rate of the refrigerant flowing in the supercooling coil 17, to keep the degree of superheating at the discharge of the compressor 1 at a predetermined value. The refrigerant flowing into the supercooling coil 19 is cooled in the supercooling coil 19 by the two-phase refrigerant that has passed through the pressure reducing device 18.

After that, the refrigerant is distributed between the pressure reducing device 18 and the pressure reducing device 6. The refrigerant flowing into the pressure reducing device 18 is pressure-reduced, and then heated in the supercooling coil 19 by the refrigerant that has passed through the supercooling coil 17. After that, on the suction side of the compressor 1, the refrigerant merges with the gas refrigerant that has passed through the outdoor heat exchanger 3.

Meanwhile, the refrigerant flowing into the pressure reducing device 6 is pressure-reduced by the pressure reducing device 6 to become a low-temperature, low-pressure two-phase refrigerant. This refrigerant heat-exchanges in the outdoor heat exchanger 3 with the outdoor air supplied by the outdoor blower 4, and evaporates to become a low-pressure gas refrigerant. The pressure reducing device 6 controls the flow rate of the refrigerant flowing in the water heat exchanger 20, to keep the degree of superheating during suction by the compressor 1 at a predetermined value. Therefore, the high-pressure liquid refrigerant condensed in the water heat exchanger 20 has a predetermined degree of supercooling. In this manner, the refrigerant flows in the water heat exchanger 20 at a flow rate corresponding to the operation load required by the water temperature.

The low-pressure gas refrigerant flows via the four-way valve 2 and merges with the refrigerant passing through the pressure reducing device 18 and supercooling coil 19, and is taken by the compressor 1. Note that the refrigerant tank 22 is installed in order to reserve unnecessary refrigerant in the heating mode.

In this embodiment, the refrigerant tank 22 is filled with the saturated gas in the cooling mode, and with the supercooled liquid in the heating mode. As the interior of the refrigerant tank 22 is of a single phase, the refrigerant amount can be calculated.

In the supercooling coil 17 and supercooling coil 19 as well, the refrigerant amounts can be acquired based on the corresponding operation state amounts. Therefore, the refrigerant amount in the refrigerating circuit can be calculated based on the operation state amounts of the respective elements.

Hence, even when the refrigerating cycle apparatus is of a type that comprises a unit having a plurality of refrigerant tanks and a plurality of supercooling coils, the refrigerant amount excess/shortage can be determined at high precision under any installation conditions and environmental conditions without using a specific detection device that detects the liquid level. Also, by calculating the refrigerant amount periodically, refrigerant leakage can be discovered at an early stage, and a failure of the device can be prevented.

In the supercooling coil 17 or supercooling coil 19, if liquid refrigerant amount correction is conducted, it can be expected that precision of the refrigerant amount excess/shortage determination be improved.

INDUSTRIAL APPLICABILITY

In a refrigerating cycle apparatus in which a factor such as a heat exchanger whose refrigerant amount is difficult to calculate exists, even if the refrigerant amount charged on the site fluctuates, by utilizing the present invention, the excess/shortage of the refrigerant amount in the refrigerating circuit can be determined at high precision based on the operation state.

REFERENCE SIGNS LIST

1 compressor, 2 four-way valve, 3 outdoor heat exchanger, 4 outdoor blower, 5 liquid connection pipe, 6 pressure reducing device, 7 indoor heat exchanger, 8 indoor blower, 9 gas connection pipe, 10 accumulator, 11 discharge pressure sensor, 12 suction pressure sensor, 13 receiver, 14 supercooling coil, 15 pressure reducing device, 16 pressure reducing device, 17 supercooling coil, 18 pressure reducing device, 19 supercooling coil, 20 water heat exchanger, 21 water supply pump, 22 refrigerant tank, 23 check valve, 24 check valve, 25 check valve, 26 check valve, 27 check valve, 101 measurement part, 102 calculation part, 103 control part, 104 storage part, 105 comparison part, 106 determination part, 107 notification part, 201 discharge temperature sensor, 202 outdoor temperature sensor, 203 liquid-side temperature sensor, 204 liquid-side temperature sensor, 205 indoor temperature sensor, 206 suction temperature sensor, 207 inflow water temperature sensor, 208 outflow water temperature sensor, 209 liquid-side temperature sensor, 210 liquid-side temperature sensor, 301 heat source unit, 302 utilization unit.

The invention claimed is:

1. A refrigerating cycle apparatus comprising:

not less than one heat source unit having at least a compressor and a heat source side heat exchanger;

not less than one utilization unit having at least a pressure reducing device and a utilization side heat exchanger;

a refrigerating circuit formed by connecting the heat source unit and the utilization unit via a liquid connection pipe and a gas connection pipe;

a storage part that stores at least an appropriate refrigerant amount of a refrigerant to be charged in the refrigerating circuit and a correction coefficient which corrects a liquid refrigerant amount so that calculation of a refrigerant amount of each constituent element of the refrigerating circuit and the appropriate refrigerant amount become equal to each other;

a measurement part that detects an operation state amount in each constituent element of the refrigerating circuit;

a calculation part that calculates the refrigerant amount of each constituent element of the refrigerating circuit based on the operation state amount by using the correction coefficient;

a comparison part that compares the appropriate refrigerant amount and a calculative refrigerant amount which is calculated by the calculation part; and a determination part that determines excess/shortage of a refrigerant amount charged in the refrigerating circuit based on a comparison result of the comparison part.

2. The refrigerating cycle apparatus according to claim 1, further comprising a refrigerant flow rate calculation part that calculates a refrigerant flow rate in the heat source side heat exchanger or the utilization side heat exchanger, the refrigerant flow rate calculation part serving to detect a change in a calculative refrigerant amount in one of the heat source side heat exchanger and the utilization side heat exchanger with respect to the refrigerant flow rate flowing in a corresponding one of the heat source side heat exchanger and the utilization side heat exchanger.

3. The refrigerating cycle apparatus according to claim 1, wherein the calculation part corrects calculation of a proportion of a liquid-phase refrigerant existing in a condenser based on an operation state amount of the condenser.

4. The refrigerating cycle apparatus according to claim 1, wherein the calculation part corrects calculation of a liquid refrigerant amount existing in the refrigerating circuit by using an operation state amount at any one position of a flow channel running from downstream of the condenser through upstream of the pressure reducing device.

5. The refrigerating cycle apparatus according to claim 1, wherein the calculation part corrects calculation of a liquid refrigerant amount existing in the refrigerating circuit based on a specification of the liquid connection pipe, a specification of the gas connection pipe, an operation state amount of the liquid connection pipe, and an operation state amount of the gas connection pipe.

6. The refrigerating cycle apparatus according to claim 1, wherein the calculation part calculates a refrigerant density in the liquid connection pipe based on an operation state amount at a position downstream of the condenser and upstream of the liquid connection pie, and an operation state amount at a position downstream of the liquid connection pipe and upstream of the pressure reducing device.

7. The refrigerating cycle apparatus according to claim 1, wherein the calculation part calculates a refrigerant density of the gas connection pipe based on an operation state amount at a position downstream of the evaporator and upstream of the gas connection pie, and an operation state amount at a position downstream of the gas connection pipe and upstream of the compressor.

8. The refrigerating cycle apparatus according to claim 1, further comprising a timer in the refrigerating cycle apparatus, so that a refrigerant amount is determined every predetermined time using the timer.

9. The refrigerating cycle apparatus according to claim 1, wherein the storage part stores the operation state amount detected by the measurement part, and the determination part determines the refrigerant amount by using moving average data of the operation state amount.

10. The refrigerating cycle apparatus according to claim 1, wherein the storage part sequentially stores a degree of divergence between the calculative refrigerant amount and the appropriate refrigerant amount, and predicts refrigerant leakage from the refrigerating circuit based on a trend change in degree of divergence between the calculative refrigerant amount and the appropriate refrigerant amount.

11. The refrigerating cycle apparatus according to claim 1, wherein the refrigerating cycle apparatus is connected to a management device that manages respective constituent devices and acquires operation data by communicating with an outside via a wire or a wireless manner, the management device is connected via a network to a remote server that receives the operation data, and the remote server is connected to the storage part that stores the operation state amount, so that a refrigerant amount determination system is constituted.

12. The refrigerating cycle apparatus according to claim 1, wherein the storage part is one of a memory in a substrate in the apparatus, a memory attached to a compressor, and a memory in a device installed outside the apparatus and connected to the apparatus via a wire or in a wireless manner, and the storage part comprises a rewritable memory.

13. The refrigerating cycle apparatus according to claim 1, wherein the refrigerating cycle apparatus uses a refrigerant that accompanies a change in physical properties in a supercritical range.

14. The refrigerating cycle apparatus according to claim 1, further comprising:

a receiver provided at a position downstream of the condenser and upstream of the pressure reducing device and serving to reserve an excessive refrigerant;

a high-pressure detection device that detects a pressure of a refrigerant at any one position of a flow channel running from downstream of the compressor through upstream of the pressure reducing device; and a control part that controls an operation capability of the compressor, wherein the control part performs the control such that a pressure detected by the high-pressure detection device has a predetermined value, so that special operation of moving the excessive refrigerant in the receiver to the condenser upstream of the receiver is performed.

15. The refrigerating cycle apparatus according to claim 14, further comprising a control part that controls an opening area of the pressure reducing device such that a temperature at any one position downstream of the evaporator and upstream of the condenser has a predetermined value, so that special operation of further moving the excessive refrigerant in the receiver to the evaporator is performed.

16. The refrigerating cycle apparatus according to claim 14, further comprising:

at least one bypass unit including a supercooling coil provided at a position downstream of the condenser and upstream of the pressure reducing device, and a distribution circuit that branches from a position downstream of the supercooling coil and upstream of the pressure reducing device, has a second pressure reducing device, passes through the supercooling coil, and connects to the compressor; and a control part that controls an opening area of the second pressure reducing device, wherein the control part controls an opening area of the second pressure reducing device such that a temperature at a position downstream of the compressor and upstream of the condenser has a predetermined value, so that special operation of further moving the excessive refrigerant in the receiver to the condenser is performed.

17. The refrigerating cycle apparatus according to claim 1, further comprising:

at least one bypass unit including a supercooling coil provided at a position downstream of the condenser and upstream of the pressure reducing device, and a distribution circuit that branches from a position downstream of the supercooling coil and upstream of the pressure reducing device, has a second pressure reducing device, passes through the supercooling coil, and connects to the compressor; and a control part that controls an opening area of the second pressure reducing device such that a temperature at any one position of a flow channel running from downstream of the condenser through upstream of the pressure reducing device is constant.

18. The refrigerating cycle apparatus according to claim 1, further comprising at least one bypass unit including a supercooling coil provided at a position downstream of the condenser and upstream of the pressure reducing device, and a distribution circuit that branches from a position downstream of the supercooling coil and upstream of the pressure reducing device, has a second pressure reducing device, passes through the supercooling coil, and connects to the compressor, so that calculation of a liquid refrigerant amount existing in the supercooling coil is corrected.

* * * * *